US008986977B2

(12) United States Patent
Knoshaug et al.

(10) Patent No.: US 8,986,977 B2
(45) Date of Patent: Mar. 24, 2015

(54) DISRUPTION OF CELL WALLS FOR ENHANCED LIPID RECOVERY

(71) Applicant: Alliance for Sustainable Energy, LLC, Golden, CO (US)

(72) Inventors: Eric P. Knoshaug, Golden, CO (US); Bryon S. Donohoe, Golden, CO (US); Henri Gerken, Queen City, AZ (US); Lieve Laurens, Denver, CO (US); Stefanie Rose Van Wychen, Boulder, CO (US)

(73) Assignee: Alliance for Sustainable Energy, LLC, Golden, CO (US)

( * ) Notice: Subject to any disclaimer, the term of this patent is extended or adjusted under 35 U.S.C. 154(b) by 0 days.

(21) Appl. No.: 13/731,578

(22) Filed: Dec. 31, 2012

(65) Prior Publication Data

US 2013/0171721 A1 Jul. 4, 2013

Related U.S. Application Data

(60) Provisional application No. 61/581,985, filed on Dec. 30, 2011.

(51) Int. Cl.

| | |
|---|---|
| ***C11B 1/00*** | (2006.01) |
| ***C11B 1/10*** | (2006.01) |
| ***C11B 1/02*** | (2006.01) |

(52) U.S. Cl.
CPC .. *C11B 1/10* (2013.01); *C11B 1/025* (2013.01)
USPC ..... 435/271; 435/267; 435/71.1; 435/69.1

(58) Field of Classification Search
None
See application file for complete search history.

(56) References Cited

U.S. PATENT DOCUMENTS

| | | | | |
|---|---|---|---|---|
| 5,051,365 | A | 9/1991 | Polne-Fuller | |
| 6,607,902 | B2 * | 8/2003 | Schroder et al. | 435/232 |
| 7,431,952 | B2 * | 10/2008 | Bijl et al. | 424/780 |
| 8,361,778 | B2 * | 1/2013 | Bergmaier | 435/252.9 |
| 2001/0031489 | A1 * | 10/2001 | Steinbuchel et al. | 435/135 |
| 2003/0022347 | A1 * | 1/2003 | Sjoholm et al. | 435/208 |

(Continued)

FOREIGN PATENT DOCUMENTS

| | | | |
|---|---|---|---|
| EP | 2341136 | A1 * | 7/2011 |
| WO | WO 2005063953 | A1 * | 7/2005 |

(Continued)

OTHER PUBLICATIONS

Gerken et al., "ST3-09: Regulated enzymatic disruption of algal cell walls for enhanced lipid recovery", 33rd Symposium on Biotechnology for Fuels and Chemicals, May 2, 2011, Seattle, Washington, accessed May 28, 2013, p. 1, available at www.sim.confex.com/sim/33rd/webprogram/Paper18255.html.

(Continued)

*Primary Examiner* — Robert Mondesi
*Assistant Examiner* — Richard Ekstrom
(74) *Attorney, Agent, or Firm* — John C. Stolpa

(57) ABSTRACT

Presented herein are methods of using cell wall degrading enzymes for recovery of internal lipid bodies from biomass sources such as algae. Also provided are algal cells that express at least one exogenous gene encoding a cell wall degrading enzyme and methods for recovering lipids from the cells.

20 Claims, 9 Drawing Sheets

(56) References Cited

U.S. PATENT DOCUMENTS

| | | | | |
|---|---|---|---|---|
| 2003/0186879 | A1* | 10/2003 | Sturley et al. | 514/12 |
| 2005/0170479 | A1* | 8/2005 | Weaver et al. | 435/134 |
| 2006/0026715 | A1* | 2/2006 | Hood et al. | 800/284 |
| 2009/0151026 | A1* | 6/2009 | Maranta et al. | 800/298 |
| 2009/0324574 | A1* | 12/2009 | Mathur et al. | 424/94.6 |
| 2010/0151540 | A1* | 6/2010 | Gordon et al. | 435/134 |
| 2010/0233761 | A1* | 9/2010 | Czartoski et al. | 435/71.1 |
| 2010/0304452 | A1 | 12/2010 | Oyler | |
| 2011/0097786 | A1* | 4/2011 | Howard et al. | 435/277 |
| 2011/0167714 | A1 | 7/2011 | Lindell et al. | |
| 2011/0306117 | A1* | 12/2011 | Lam et al. | 435/267 |
| 2011/0312062 | A1* | 12/2011 | Nordvik et al. | 435/257.1 |

FOREIGN PATENT DOCUMENTS

| | | | |
|---|---|---|---|
| WO | WO 2008155410 | A1 * | 12/2008 |
| WO | WO 2010039030 | A1 * | 4/2010 |

OTHER PUBLICATIONS

Kutish et al., "Analysis of 76 kb of the Chlorella Virus PBCV-1 330-kb Genome: Map Positions 182 to 258", Virology, Jul. 1996, vol. 223, pp. 303-317.

Laurens et al., "Accurate and reliable quantification of total microalgal fuel potential as fatty acid methyl esters by in situ transesterification", Analytical and Bioanalytical Chemistry, Feb. 2012, vol. 403, pp. 167-178.

Li et al., "Analysis of 74 kb of DNA Located at the Right End of the 330-kb Chlorella Virus PBCV-1 Genome", Virology, Aug. 1997, vol. 237, pp. 360-377.

Lu et al., "Analysis of 94 kb of the Chlorella Virus PBCV-1 330-kb Genome: Ma Positions 88 to 182", Virology, Feb. 1996, vol. 216, pp. 102-123.

Sun et al., "Characterization of β-1,3-Glucanase Encoded by Chlorella Virus PBCV-1", Virology, Jul. 2000, vol. 276, pp. 27-36.

* cited by examiner

Figure 2

ATGTCTCAAGTAGACACCGTGGTAGACTCCGTGGTAGACGTCGAAAACCATCAGCCCACACATATCGACACTTTC
CCATACAATAAACGGGTTATTGAATCTAAACCCAAAAAAAATATGATTGTCCGCGGTGTTGTTATTTGCATGGCG
ATCCTTATTTTCGGGGGAGCAATTGCCACAGCAATTGTGGTGAGTTCTGATAATTCCTCAGACCAGGCCCCAGCT
CCAGCGCCAGGACCAGCCCTTATTTACAAAGGCGCGTATATTGACGAACCTCCGCCGTTTGAACCAAAGGCTGGG
TTTGAAGCCATGTGGTGGGATGAGTTTGACGGCGAAGAAATCGACCGTACAAAATGGTACATCCAGCCCGATATT
GTTGATTATTATACCGGGAATAGACAGATTCAACATTATATTGATTCTCCTTCTACAATAGAAGTATCCAACGAT
ACACTTCACATTATTGCCAATAACCCTGGTGAAGTGCAATATAACGAAACCTCGAGTAACTACGATCAAACATAT
TACACTTCAGCGCGCATAAACACAAAAACAACTGGAGGACATTGGTATCCGGGGATGGAGGTAAATGGTACAACG
TGGAATACCATTCGAGTAGAGGCGCGGCTAAAGGCGCCGAGAGGTCCGGGAGTTGTCGGTGCTTTTTGGATGCTA
CCTATTGACAATAGTTGCTTCCCAGAAATTGATATTTTTGAGACGCCATACTGCGAAAGAGCATCCATGGGCACG
TGGTACGTAAACAAAGATGTCCCAAGAGGTATCTCAAAGCATGGCACCACGATCACGGAAAGTTATGATAAGTTT
TGTGACGAATACGTTACATATGCCGTTGAATGGAACGCAGATTATATTGCATTTTATGCGGGTGACGCTGAAACC
CCGGTTTTTGTGACTGGAAAAGAAATCTGGGCTGGAAAATGCGATGCAAACGATACTGATGCACCTTACAACCGA
CCTTTTTATATTATTCTGAATACATCTATCGGGTCCGCATGGGGCGGTATCCCATTGAATGATATTTTCCCTGCA
GTTCTAGACGTAGACTACGTGCGGGTTTCAGGCATTCGCGAT

Figure 3

ATGGGATCGTATTTTGTCCCACCGGCGAATTATTTTTTCAAAGATATTTTCGCGTCAAATGTTGGAAACATAGCA
AACGTAATTTTTGATAACGGTAATGTTATAGCTGCCGGAGGTCTTGGTTACTTAATAGGTAACGGCGCATTCATC
ACGGGAGTCACATCAACTGCAATAGCGAACATTCCAGCAGTAGTGACCGCAGATATCCGCGGAAATCTCATCGGT
AACTACGCCAATGTCAACAATATAATTGCATCATCTGGAAACATCTCTAACGTCAGATTCGTATCGGGTGGAAAC
GTGACGGCATCTTATTATTTCGGAGATGGGTCTCAGTTGACTGGTATCACCGCGACTGCTAATATCCCATCCATA
GTGACTGCAGACATCCGAGGTAACATCATCGGTAATTACGCAAACGTCAGCAACGTATCTGCAACCTTCGGAAAC
ATCGCGAACGTGCTGTTCAACAACGGTAATGTGACGGCAGCGGGTGGTAACGGGTTCTTTATAGGAAACGGATCG
CTGTTGACCGGAATCACCGCGACTGCTAATATCCCATCCATAGTGACTGCAGACATCCGAGGTAACATCATCGGT
AATTACGCCAACGTCAGCAACGTATCTGCAACCTTCGGGAACATCGCAAATGTGTTGTTCAACAACGGAAACGTA
ACGGCAGCGGGTGGTAACGGGTACTTCTTCGGGAATGGGGCGTTGTTGACCGGAATCACCGCGACTGCTAATATC
CCATCCATAGTGACCGCAGACATCCGAGGTAACATCATCGGTAATTACGCCAACGTCAGCAACGTATCTGCAACC
TTCGGGAACATCGCAAATGTGTTGTTCAACAACGGAAACGTAACGGCAGCGGGTGGTAACGGGTACTTCTTCGGG
AATGGGGCGTTGTTGACCGGAATCACCGCGACTGCTAATATCCCATCCATAGTGACTGCAGACATCCGCGGAAAC
ATCATCGGTAACTACGCCAACGTCAGCAACGTATCTGCAACCTTCGGAAACATCGCGAACGTGTTGTTCAATAAT
GGAAACGTAACGGCAGCGGGTGGTAATGGGTTCTTCATCGGAAATGGGTCGTTGCTGTCTGGTATCACCGCGACT
GCTAATATACCATCCATAGTGACTGCAGATATCCGAGGTAACATCATTGGCAACTATGCAAACGTCAGCAACGTA
ACGGCAACGTTTGGAAACATCGCAAATGTGTTATTCAACAATGGAAACGTAACGGCAGCGGGTGGTAATGGTTAT
TTCTTCGGGAACGGGTCCCAGTTGACCGGTGTCACTGCCACTTTACCTTCCATAGTAACCGCAGACATCCGCGGA
AACATCATTGGCAACTACGCAAACGTCAGCAACGTAATCGCAACGTTCGGAAACATCGCAAATGTGTTATTCAAC
AATGGAAACGTAACGGCAGCGGATGGCAATGGTTACTTCTTCGGGAATGGGTCCCAATTGACCGGTGTCACTGCC
ACTTTACCTTCCATAGTAACCGCAGACATCCGCGGAAACATCATTGGCAACTACGCAAACGTCAGCAACGTAATC
GCAACGTTCGGAAACATCGCAAATGTGTTATTCAACAATGGAAACGTAACGGCAGCGGGTGGTAACGGTTACTTC
TTCGGGAATGGGGCGTTGTTGACCGGAATCACCGCGACTGCTAATATCCCATCCATAGTGACTGCAGACATCCGC
GGAAACATCATTGGCAACTACGCAAACGTCAGCAACGTAATCGCAACGTTCGGAAACATCGCAAATGTGTTATTC
AACAATGGAAACGTAACGGCAGCGGATGGCAATGGTTACTTCTTCGGGAATGGGTCCCAATTGACCGGTGTCACT
GCCACTTTACCTTCCATAGTAACCGCAGACATCCGCGGAAACATCATTGGCAACTACGCAAACGTCAGCAACGTA
ATCGCAACGTTCGGAAACATCGCAAATGTGTTATTCAACAATGGAAACGTAACGGCAGCGGGTGGTAACGGTTAC
TTCTTCGGGAATGGGGCGTTGTTGACCGGAATCACCGCGACTGCTAATATCCCATCCATAGTGACTGCAGACATC
CGCGGAAACATCATCGGTAATTACGCAAACGTCAGCAACGTAACGGCAACGTTCGGAAACATCGCGAACGTGTTG
TTCAACAACGGAAACGTGACGGCAGCGGGTGGTAATGGTTATTTCTTCGGGAACGGGTCCCAGTTGACCGGTGTC
ACTGCCACTTTACCTTCTATAGTAACCGCAGACATCCGCGGAAACATCATCGGTAACTACGCAAACGTTAGCAAC
GTAATCGCAACCTTTGGGAACATCGCGAACGTGTTGTTCAATAATGGAAACGTAACGGCAGCGGGTGGTAACGGG
TACTTCTTCGGGAATGGGGCGTTGTTGACCGGAATCACCGCGACTGCTAATATACCTTCTATAGTGACTGCAGAC
ATTCGAGGTAACATCATCGGTAACTATGCCAACGTCAGCAACGTAACGGCAACCTTCGGAAACATCGGAAACGTG
CTGTTCAACAACGGTAACGTAACTGCAGCAGGCGGTAACGGGTACTTCTTCGGAAACGGAACTTTCCTCAACTTT
TCCACTATAACTGCCGATATCCGCGGGAACATCATAGGCAACTATGCAAACGTCGGGAACGTTATTGCAGGTAAC
GTATCAACAACCCTCGGAAACATCGGAAACGTGCTGTTCAACAACGGTAACGTAACGGCAGCAGGCGGTAACGGG
TACTTCTTTGGAAATGGTACCTCACTCACTTTTTCTACGATAAGAGCTGATATTCGCGGAAATATCATTGGTAAT
TATGCCAACGTTGCAAACGTGATCGCGGGTAATGTCAACTCAACCTTTGGAAACATCGCTGGTGTTACATTTGAC
GCTGGAAACGTATCATCGCCCGTGGACATTTTGGTGTCTGGTAATGTATCTGTAGGTTCTGATGGATTATTCAGA
GGTCCAACTAACCAATCAAACAATGCACTAATTTTAAGAGGTATTGGAGGTACAAACACTGTTAATCTGTTCAGT
ATAGGTGCTCCTTCGGGTCAG

Figure 4

ATGGCGACCGTACCAAGCACAAAACTCGAATTAACCGTTTCTAAAACATCCGACTGGAATACCGGATATGACGGA
CAATTCAAACTTGAAAACAAGAATGATTATGATATTCTTCAATGGGGGATGACATTTGATTTTCCTGAATCTGAA
AACTTTACATGGTTCAGCGAAGGCGACCTTGTTCGTAAGGGTAACAAGGTGACTATGATACCAAAAGATTGGAAC
ATGTCAATTCCCGCGGGAACGACGAAAATCATACCTTTTGGAGGTGTGAAAGCTCTCCCTGGAAATCTTAAATAC
AACCAAATCCTACCACTCGTAGGTAAGGATCCTTCTTTGGCAAAAAGAGGTAAATGGTCTTCTAAAGCCGTAGCC
CCGTACGTAGACGCTTGTGCTTTCCCAACTCCAGATCTCCCCGCGATCAGTAAAGCAAGCGGACTGAAATTCTTT
ACTCTTGCGTTTATCACTGCTGACAGCAATAACAAAGCGAGCTGGGCGGGAACTATCCCTCTATCGAGTCAGCAT
CTTCTATCCCAGGTGCGCCAAATCAGAAGTTCTGGAGGTGATATTTCTATTTCGTTCGGCGGTGCAAACGGTATA
GAACTTGCGGATGCTATTAAGGACGTTGACGCTCTTGTAGCCGAGTATAGTAGAGTAATCGACTTGTATTCTCTG
ACACGTATTGACTTTGATATCGAAGGTGGTGCGGTCGCTGATACCGAAGGAGTTGACAGACGTAACAAAGCTATC
AATATCTTGAACAAGAAGTACCCTAATTTGCAAATAACATACTGTCTCCCCGTGTTACCAACAGGACTTGCTCTC
GCGGGTGAACTCCTGGTGCGCAATGCCAGAGTGAACAATGCTATAATACATTCATTCAACGGTATGTCAATGGAT
TTTGGAGATTCCGCGGCTCCTGACCCGGAAGGTCGTATGGGAGATTATGTAATAATGTCTTGTCAAAACCTTCGA
ACCCAAGTTTTGTCCGCTGGGTATGATTCTCCAAACATAGGAACCATTCCTATGATCGGAGTTAACGACGTAGAG
AGTGAAGTGTTCAGAATTTCTGACGCAAAGAAGGTGTATGATTTCTTCCAGAGCATCCCCTGGATGACCTATGTC
GGTTTTTGGTCCACAAATCGCGACAATGCAGGCCAGGGTCAAGGTGCCAACCCATTCAATTCGGGTATAAAACAA
AACCCGTATGACTTTAGTAAAACTTTCCTCGGAAAGAAAGTACTCGAATTAGACCCCAGTCCTAGACCAAACCCC
CCTCATATCCCACCCCCTGGTGGAGATCCTAACCCACTTCCACCCGTAGGCCCCGTTGATCCCAGTCCTAAACCT
CCTACGCCGAAACCTCCCACACCAAATCCTCCTACCAATCCTGAAAAACCCCAGAAACCAGTTCAGAAACCGAAT
GTGAACGCAGATTGGTGCAACGTGTCTCTCGAATTCGTACGCAGGTGTCGTGACGGCGAAGCCCCTGATGCAGTA
ATTAAGGATCTTCAAACAAGATATTCTGGCCTGGGTCCGGAAAATCAGAAGGCCCTCAAGAAACTTCTTGACCCC
TCAAAGCCCGTTGACCCTAAACCCGTTGACCCTAAACCCGTTGACCCTAAACCCGTTGACCCTAAACCACCTGTT
AAAAGCAATCGATTTTTCACACCATACACAGAGTCTTGGCAATATTGGAGTGGGTGGAACAATGCCAAGACTCTA
GAACAAATTCCAACAAAGAACGTGACTCTTGCATTCGTATTATACGCCGATGGTGTTCCTAAGTTCGACGGGACT
ATGGACGCGAATATTTATGTTGACCAGGCGAAAATAGTCCAGACTAAGGGCGGAATCGTCCGTATTTCTTTCGGT
GGTGCCACTGGAACTGAACTAGCACTCGGTATCAAAGACGTAAACAAACTTGCTGCTGCATATGAAAGCGTCATA
AAGATGTACAATACCAGAAATATTGATATGGACATCGAAGGAGGCCCCGCTTCTGACATGGATAGTATCACTCGT
AGAAACAAGGCGCTTGTCATTTTGCAAAAGAAGTATCCAGATTTGAAAGTCGACTATACTCTCGCGGTGATGCAA
ACAGGTCTTTCCACTCAGGGATTGGATATCCTGAAGGATGCGAAAAAACAAGGTCTAAAAGTCCACGCAGTGAAT
ATCATGGCTATGGACTATGGCACTAATGAAAAACAAATGGGAAAAGCAGCGATCAGTGCCGCTACTGCAACGAAG
AAGCAGTGTGATGACTTGGGCCTCGTTTATGAAGGTGTGGGCATCACCCCGATGATCGGTCTAAACGACACATCT
CCGGAAACATTTACTATTGATAACGCCAAGGAAGTCGTCGATTTCGCAAAGAAAACGTCTTGGGTAAATTTCTTG
GGATTTTGGGCGACCGGGCGTGACAATGCCAAAGATACCAAAGTTAAGCAAGTGATGTGGGAATTCACAAATATA
TTCAACACATTTGCG

Figure 5

ATGAATGGAAACGACAACTGGGATAACGTAGTAAAAGATTACAATAATCTTAGAAAAAACGGCCATGATGAACAA
GAAACAATTTCAATAATAAGACGTAAGTATACCGACATAGGTCCTGTTAATCAAAAAAGGTTAGAAGACCAATAC
GAAAAGATAAAACCTTCCCAAAAACCCGCTCCAAAACCCGCTCCCAAAACCGCGCCAAAATCCCCTCCGGCAACA
AAAAATACAAATGTTATAAGCACGTTAGATTTGAATTTGTTAACAAAGGGGGGTGGTTCTTGGAATGTAGATGGT
GTGAACATGAAGAAAAGTGCCGTGACAACATTTGATGGCAAGCGTGTCGTCAAGGCTGTATATGATAAAAACTCA
GGGACGAGTGCAAACCCCGGGGTTGGCGGGTTCAGTTTTTCCGCAGTTCCGGATGGTCTTAACAAAAACGCCATA
ACATTCGCTTGGGAAGTATTTTATCCAAAAGGATTCGATTTTGCACGAGGGGGCAAACACGGGGGAACGTTTATA
GGTCATGGAGCTGCTTCTGGATATCAGCATTCTAAAACGGGTGCATCGAATAGGATCATGTGGCAACAAGATGGA
GGTGTCATAGACTACATTTACCCTCCCTCTGATCTAAAACAAAAGATCCGTGGTCTCGACCCCGAAGGGCATGGA
ATCGGATTTTTCGAGGATGACTTTAAAAAAGCGCTGAAATATGACGTATGGAATCGTATAGAAATTGGAACGAAG
ATGAATACTTTCAAGAACGGGGTTCCTCAGTTAGATGGCGAATCCTATGTTATCGTCAACGGAAAGAAGGAGGTC
TTAAAAGGAATAAATTGGTCTAGAAGTCCTGATTTGGTGATAAACAGGTTCGATTGGAACACATTTTTTGGAGGT
CCACTCCCAAGTCCAAAGAATCAGGTAGCATACTTCACGAATTTCCAAATGAAGAAATACGAA

Figure 6

ATGGCCCTTGCGAAACCTGCTCCGTATTATACGAGCCCCACTGGAAAACAGGCAATATATTACCATACTTCATGG
AGCTGCTACGACAGAAAGTTCTACCCCGTCAAACTACCAATTGACAAACTTACAGACATCGCATACGCATTCTTC
AACGTTGATGAGACCGGTAGGGTATTCTCCGGAGACGAGTGGAGCGACTACCAAATGCCGTTCAATGGTCCTGGC
GAAGGCGTTGAACCTCAAAATAAATGGGATTCACCACCCGAACAATTAGGACAACTAGGTCAGTTCTTGAAACTG
CTTAAAAAGGAACACAAGTTCAACATGCACGCGTCTATAGGCGGGTGGAGTTGGAGTGGTAATTTTTCCAATGCG
GTTAAAACAGAGGAAAATCGCGAGAGGTTCGTTACCAGTCTGGCGGGAATCATGAACAGATACCCAGGTCTATTT
AATTCTATTTCGCTTGACTGGGAATATGTGTCGGACGATGGTGTCAACTATGGTCTAGGCGGAAACGCCGTTAGC
AAAGAAGACCCCGATAATTTTATGAAACTCCTAAAGAAAATCCGTCAAAAGCTCCCAGGTTTTAAGATATCAATG
TGCACAATTGCCGCTCCAGAAAAACTTAAATTCCCCGTGAAAAAAGTAAGTGAACTTCTGGACGAGGTTCACGTG
ATGACATACGATTTCCTTGACGGGTCGTGGGCGCAAGGAGGTGGTCCAGCCACTGGACATCACACGAACTTTAGT
AAATCACCACTCGTTCCCTACTCGGTAACCGACGCCGCCGAAACGATGCTCAAACTCGGTGTTGACCCTAAAAAA
ATATTCGTCGGTGTTGCGTTTTATTCTAGAGGGTTCAGTGGCACCGATGGTCTAGGAAAACCATATACAGGCGGT
TCTACAGACAAAACATGGGACAATGGTTCGGTAGATTATAAATTTTTACCCCTACCTGGGGCACAAGAACTATGG
GACCCCGTTGCAAACGCTGCCTATTCATACGATCCGAAAAAAAGGGTGTTGAATTCATACGACGAACCTCGCTCT
GTAAAACTAAAATGCGACTTTGTTCACCAAAAAGGTCTCGGTGGTATCTTGGTATGGGAGGATTCCGCAGATCAC
CCGTACGATCACCCACGTTCGCTCATGAAAATTATTCACGATAATCTGACCCACGGGGAAAATGCCAAACCCGAA
CCGACCCCCAAACCCGAACCGACCCCCAAACCCGAACCGACCCCGAAACCTGAACCTACTCCAAAACCTAAACCG
ACCCCCAAACCCGAACCGACCCCCAAACCTAAACCGACCCCCAAACCTAAACCGACCCCCAAACCTAAACCGACC
CCAAAACCTAAACCGACCCCGACCCCGAAGCCTGACCCGATTCCTAAAGAAGGTATTTGGGGTGTTGACGGAGAA
TCATTCTTTTATAATGGTGGTATTAAAATGAATTGTCCACCAGGGCTCGTATGGAACTCGACGAGTAAATCTTGT
GATTGGCCTAAGAAA

Figure 7

ATGTCAAACAAAATAGAAATAACAGACGATAATAAAATGACGATTCAAAACGACTTTGTATCACGGATGATGAAG
AGTATCGATCAGGAACTCGTTGCCATGACGAACAAATATTCTGGGTTCGGTCCTGGCAGACAGACGAATTGCAAA
AAAGCTCTTGCAAAGGCCCTCGGAGAAACCCCAGTCAACCCCCCAGTCAACCCCCCAGTAACCCCTCCTGTAGAT
ACACATATTCCTTCACAGGTCGAAGCTCCTTTGAAAAAACTAGGCTTCAATACAACAAATGCAGACACGATCTTA
TCACTCATCGCGCTCCCGGAAAACTCTACAACCCAATGGTGGAAAAATTACAATTACGCAAGTTGTCTAAAGGAC
GGTCGTGGATGGACAGTAACAATTTACGGTGCATGCTCTGGGACTGGTGATCTGTTGATGGTATTGGAGTCTCTG
CAAAAAATAAACCCTAACCACCCACTCGTGAAATTCATCCCCGCAATGAGGAAAACCAAGGGAGATGATATCAGA
GGCCTCGAAAATCTCGGGAAAGTAATCAACGGGCTCGGCGACGACAAAGAATGGCAAACGGCGGTGTGGGACATA
TACGTCAAATTATATTGGACTTTTGCTGCCGATTTTTCAGACAAGACTGGAAGTGCGAAAAACCGCCCCGGGCCC
GTTATGACGTCACCATTGACACGTGGTTTTATGGTAGATGTTGCGTTGAACCACGGGAGTAATATGGAATCCTTT
TCCGACATTCTAAAGAGAATGAAAAATCGCGAAGAGAAAGACGAGGCGAAATGGTTCCTCGATTTCTGCGAGACA
AGACGTAAACTTCTAAAAGCTGGTTTCCAAGATCTTGATACTTCTAAAACAGGAGATCGCTGTACACTTTGGGCA
AACATCTTCAAAGAAGGAAACGTTGGGCTGAAACGCCCGATAAAATGCTACAATGGTTACTGGGGTAAAAACATA
GTTATTTCA

DISRUPTION OF CELL WALLS FOR ENHANCED LIPID RECOVERY

CROSS-REFERENCE TO RELATED APPLICATIONS

This application claims priority to U.S. Provisional Application No. 61/581,985, filed Dec. 30, 2011, the contents of which are incorporated by reference in their entirety.

CONTRACTUAL ORIGIN

The United States Government has rights in this invention under Contract No. DE-AC36-08GO28308 between the United States Department of Energy and Alliance for Sustainable Energy, LLC, the Manager and Operator of the National Renewable Energy Laboratory.

REFERENCE TO SEQUENCE LISTING

This application contains a Sequence Listing submitted as an electronic text file entitled "NREL_10-56_Seq_ST25.txt," having a size in bytes of 78 kb and created on Dec. 27, 2012. Pursuant to 37 CFR §1.52(e)(5), the information contained in the above electronic file is hereby incorporated by reference in its entirety.

BACKGROUND

Oil from algae is currently being investigated as a source of advanced biofuels capable of providing a significant portion of worldwide jet and diesel fuel needs. However, several technological hurdles remain, including the efficient extraction of lipids from the algal cells. The current technology primarily relies on flammable, environmentally toxic, and expensive solvents. In addition, most extraction processes require that algal biomass be dewatered to dryness, a significant cost contribution. Developing technology to eliminate solvent extraction will create a simple, environmentally sound, and economical lipid recovery process.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods that are meant to be exemplary and illustrative, not limiting in scope. In various embodiments, one or more of the above-described problems have been reduced or eliminated, while other embodiments are directed to other improvements.

Exemplary embodiments provide methods for recovering lipids from a cell by contacting the cell with at least one cell wall degrading enzyme and isolating lipids from the cell.

In certain embodiments, the cell wall degrading enzyme is a proteinase, chitinase, chitosanase, sulfatase, lyticase, lysosyme, alginate lyase or pectate lyase; or is A94L, A122R, A181/182R, A215L, A260R, or A292L from the *Chlorella* virus PBCV-1. In some embodiments, the cell is a microbial cell, a yeast cell, or an algal cell, such as from the genus *Chlorella* (e.g., a strain of the species *C. vulgaris*), *Nannochloropsis*, or *Selenastrum*.

In certain embodiments, the cell expresses at least one exogenous gene encoding a cell wall degrading enzyme, which may be under the control of an inducible promoter.

In some embodiments, the step of contacting the cell comprises inducing the expression of the at least one exogenous gene encoding a cell wall degrading enzyme.

In certain embodiments, the induced exogenous gene is a gene isolated from the *Chlorella* virus PBCV-1, such as A94L, A122R, A181/182R, A215L, A260R, or A292L.

In some embodiments, the induced cell is further contacted with an externally added cell wall degrading enzyme.

In certain embodiments, the methods further comprise a step of dewatering the cell prior to the step of contacting the cell with at least one cell wall degrading enzyme. The cell may be dewatered to about 10-40% solids prior to the step of contacting the cell with at least one cell wall degrading enzyme.

In some embodiments, the step of isolating lipids from the cell comprises extracting the lipids by mixing the contacted cells with a hexane/isopropanol solvent and recovering the lipids from the solvent. In various embodiments, the extraction is carried out at a temperature of about 18° C. to 30° C. or for a time of about 1 to 4 hours. In certain embodiments, the solvent is 3:2 hexane:isopropanol by volume.

Also provided are methods for recovering lipids from an algal cell by culturing the algal cell, inducing expression of a cell wall degrading enzyme in the algal cell, and extracting lipids from the algal cell by mixing the algal cell with a hexane/isopropanol solvent, separating out the solids, and recovering the lipids from the solvent.

In addition to the exemplary aspects and embodiments described above, further aspects and embodiments will become apparent by reference to the drawings and by study of the following descriptions.

BRIEF DESCRIPTION OF THE DRAWINGS

Exemplary embodiments are illustrated in referenced figures of the drawings. It is intended that the embodiments and figures disclosed herein are to be considered illustrative rather than limiting.

FIG. 2 shows the nucleic acid sequence (SEQ ID NO:1) for the *Chlorella* virus PBCV-1 enzyme designated A94L.

FIG. 3 shows the nucleic acid sequence (SEQ ID NO:3) for the *Chlorella* virus PBCV-1 enzyme designated A122R.

FIG. 4 shows the nucleic acid sequence (SEQ ID NO:5) for the *Chlorella* virus PBCV-1 enzyme designated A181/182RL.

FIG. 5 shows the nucleic acid sequence (SEQ ID NO:7) for the *Chlorella* virus PBCV-1 enzyme designated A215L.

FIG. 6 shows the nucleic acid sequence (SEQ ID NO:9) for the *Chlorella* virus PBCV-1 enzyme designated A260R.

FIG. 7 shows the nucleic acid sequence (SEQ ID NO:11) for the *Chlorella* virus PBCV-1 enzyme designated A292L.

DETAILED DESCRIPTION

Presented herein are methods of using cell wall degrading enzymes for recovery of internal lipid bodies from biomass sources such as algae. Existing lipid recovery processes largely involve toxic and expensive solvents. In an effort to avoid using solvents, alternative methods have been pursued that rely on external energy inputs in the form of ultrasound, electromagnetic pulses, physical disruption, or on chemical acid or base treatments to either augment or replace extraction. These methods are costly due to the high energy required to rupture the algal cell walls.

The present methods involve the low energy and chemical inputs exemplified by secretion in current fermentation processes, and take advantage of a natural, inducible cellular response. These methods involve contacting cells with cell wall degrading enzymes prior to recovering lipids produced by the cells. The enzymes may be added to the cells from external sources or may be produced within the cells—either constitutively or in an inducible manner.

Figure 1:
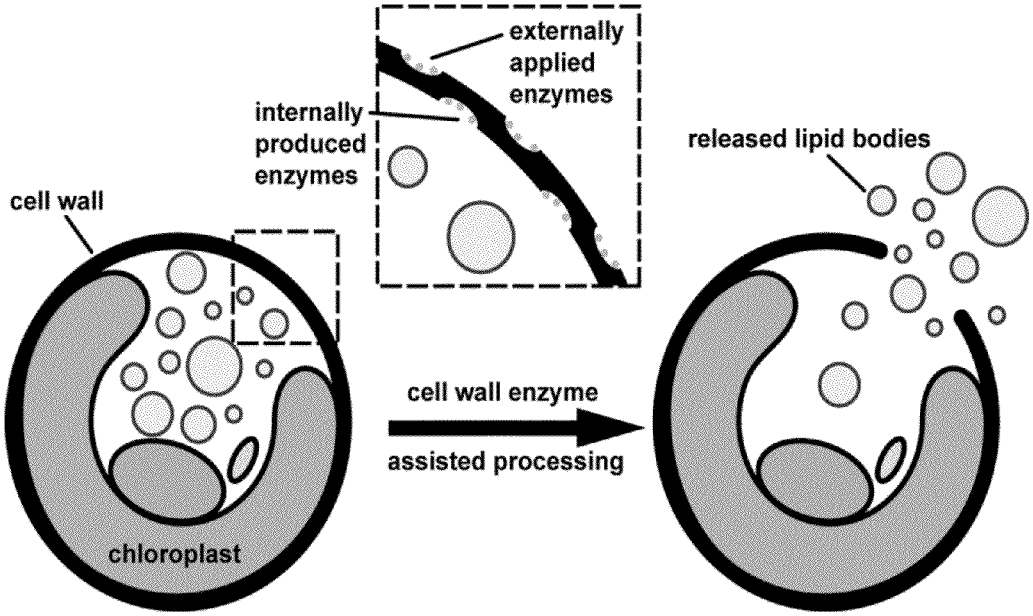
FIG. 1 shows a model for release of internal algal oil bodies by internally or externally applied enzymes.

In one embodiment, one or more algal strains capable of high oil production may be subjected to a controlled, self-induced cell wall degradation that releases internal organelles and oil bodies under a controlled external stimulus. FIG. 1 illustrates a diagram for an enzyme-based process to facilitate the oil release. Such enzymatic treatment of algal biomass can also render the residual algal biomass pretreated in a way that downstream processes like nutrient recycling, anaerobic digestion, thermal depolymerization, or gassification may be more facile. Enzymatic degradation may thus also simplify the harvesting, dewatering, and oil extraction processes.

For example, algae may be partially dewatered, to about 20% solids, then induced for self-lysis by partial cell wall degradation. Oil bodies will escape from the cells and can be easily recovered by simply skimming the surface, using an established emulsion breaking process, or using a recycled portion of the algal oil stream for enhanced recovery. External enzymes may be added for cell wall degradation or the production of the enzymes may be established in algal cells under inducible promoter control that allows for the induction of enzymatic degradation and subsequent oil release.

Prior to enzyme treatment, cell samples may be concentrated or dewatered to increase the percentage of solids in the cell samples to be treated. Suitable methods for dewatering or concentrating cell samples include filtration, dissolved air floatation, or centrifugation. Cell cultures are typically dewatered to about 5% to about 40% solids, but the energy requirement and limits on ability to pump cell cultures should be considered.

Cell wall degrading enzymes refers to any with the ability to degrade components of cell walls such as those possessed by algae. Examples include the enzyme classes listed in Tables 2 and 3 below. For example, chitinase, lysozyme, or proteinase K can be used to degrade the cell walls of *Chlorella* sp. Suitable enzymes include proteinases, chitinases, chitosanases, sulfatases, lyticases, lysozymes, alginate lyases, or pectate lyases.

Additional enzymes suitable for use in the disclosed methods include cell disrupting enzymes expressed by lytic viruses such as the *Chlorella* virus PBCV-1. Exemplary PBCV-1 enzymes include those designated A94L, A122R, A181/182R, A215L, A260R, and A292L. Nucleic acid and amino acid sequences for these enzymes are included in Table 1 below:

TABLE 1

| PBCV-1 Enzyme Sequences | | |
|---|---|---|
| PBCV-1 Enzyme | Nucleic Acid Sequence | Amino Acid Sequence |
| A94L | SEQ ID NO: 1 | SEQ ID NO: 2 |
| A122R | SEQ ID NO: 3 | SEQ ID NO: 4 |
| A181/182R | SEQ ID NO: 5 | SEQ ID NO: 6 |
| A215L | SEQ ID NO: 7 | SEQ ID NO: 8 |
| A260R | SEQ ID NO: 9 | SEQ ID NO: 10 |
| A292L | SEQ ID NO: 11 | SEQ ID NO: 12 |

The PBCV-1 enzymes disclosed above exhibit the ability to degrade cell wall components such as those found in algal or yeast cells. These enzymes may be produced in recombinant systems and added exogenously to cell cultures. Because these enzymes are typically expressed in the green alga *Chlorella*, they may also be well suited for inducible expression in algal cells used for lipid production.

Enzymes in a quantity sufficient to degrade the cell walls are added to the cell culture either during active growth, stationary phase, or after de-watering to a paste to allow for cell wall degradation. Enzymes may be added directly to the culture or with additional salts or buffers to enhance enzyme activity. The amount of time needed for cell wall degradation will vary with the cell type, and can be readily determined by one of skill in the art. Enzymes are typically added in amounts ranging from about 1 mg/g of cell slurry to about 50 mg/g of cell slurry, but these numbers may be adjusted based on experimental observations. The total amount used may include one or more enzymes in various proportions. In some embodiments, enzymes are added to cell slurries of at least 5%, 10%, 15%, 20%, 25%, 30%, 35%, 40% or greater percentage solids.

Enzymes may be contacted with the cells for a few minutes to several hours. Exemplary times include from 30 minutes to 30 hours, including at least about 0.5, 1, 2, 5, 10, 15, 20, 25 or 30 hours. The temperature of the contacting step may be room temperature or a higher temperature depending on the enzyme used. While many enzymes exhibit higher activities at temperatures above room temperature, raising the temperature to increase activity can be balanced against the amount of energy needed to raise the temperature such that the most efficient temperature can be determined for a given enzyme/cell system. Contacting may be carried out at any temperature within the range of 10° C. to 50° C. or at a temperature ranging from about 18° C. to about 37° C. Exemplary temperatures include 10, 15, 20, 25, 30, 35, 40, 45 or 50° C. In some embodiments, the contacting is carried out at between 18° C. and 25° C., such as at 18, 19, 20, 21, 22, 23, 24 or 25° C.

The algal cell wall composition for a given candidate species will determine what enzymes are chosen to degrade the cell walls. Testing various digestive enzymes on the cells will provide information about specific linkages present in algal cell walls and how those linkages can be exploited to promote oil body release. Information gained in this way can then be used to formulate the optimal conditions to break down algal cell walls.

Two analyses may be employed to find effective enzymes: examining the impacts on colony growth, and the impacts on mature cells by tracking increasing permeabilization via the entry of a DNA staining dye. An enzyme impacting growth may be important during formation of the cell wall and may inhibit growth by preventing specific linkages from forming, thereby preventing a mature cell wall from being established. For mature cell walls these enzymes may target glycosidic bonds in the complex architecture of the mature cell wall.

A plate-based assay may be used to determine the effects of various enzymes from different classes on the growth of various relevant algae. By inoculating a dilute culture into appropriate nutrient containing soft top-agar and then spotting enzymes directly on this top-agar, while the dilute culture is growing, zones of inhibition will appear around active enzymes.

An exemplary method entails growing *C. vulgaris* as a confluent lawn on the surface of an agar plate and spotting enzymes on this lawn to analyze the inhibitory effects of enzymes on cell growth. Using this method, enzymes and cell wall disruptors were tested on the following strains; *Ankistrodesmus falcatus* ANKIS1, *Chlorella* sp. CHLOR1, *C. emersonii, C. variabilis* NC64A, *C. vulgaris* (UTEX 26, 30, 259, 265, 395, 396, 1803, 1809, 1811, and 2714), *Ellipsoidon* sp. ELLIP1, *Franceia* sp. FRANC1, *Nannochloris* sp. NANNO2, *Nannochloropsis* sp. NANNP2, *Oocystis pusilla* OOCYS1, *Phaeodactylum tricornutum* CCMP632, and *Selenastrum capricornutum* UTEX1648. Table 2 shows the results of various enzyme classes for *C. vulgaris, Nannochloropsis*, and *Selenastrum*.

TABLE 2

Growth inhibition in selected algae by various enzyme classes

| | Inhibition | | |
|---|---|---|---|
| Enzyme | *C. vulgaris* | *Nannochloropsis* | *Selenastrum* |
| Alginate Lyase | No | No | No |
| Sulfatase | ++ | +++ | +++ |
| β-glucuronidase | ++ | ++ | +++ |
| Cellulase | No | No | No |
| Chitinase | +++ | +++ | No |
| Chitosanase | + | ++ | No |
| Dreiselase | No | No | No |
| Hemicellulase | No | No | No |
| Hyaluronidase | No | ++ | No |
| Lysozyme | +++ | +++ | +/− |
| Lyticase | No | +++ | No |
| Macerozyme | No | No | No |
| Pectinase | ++ | ++ | ++ |
| Pectolyase | No | No | +++ |
| Trypsin | + | +++ | No |
| Xylanase | No | No | No |
| Zymolyase | No | ++ | ++ |

As shown above, several enzymes—sulfatase, β-glucuronidase, pectinase, and lysozyme—inhibit growth of these three species. Other enzymes inhibit one or two of the species while several enzymes do not inhibit the growth of any tested species. Cellulase, hemicellulase, and xylanase do not inhibit growth of any of the three species suggesting a lack of accessible cellulose or hemicelluloses such as found in higher plant cell walls. Alginate lyase, which cleaves β-1-4 mannuronic bonds, also showed no inhibition of growth.

Enzymes may be further evaluated both alone and in combination with lysozyme for cell wall degrading effects on mature, nitrogen sufficient cells in overnight digestions. The cells may be incubated with a DNA fluorescent staining dye, such as SYTOX green, which only stains compromised, permeable cells and then subjected to image-based analysis using the ImagestreamX, thus providing a quantifiable measure of increased permeability In the absence of enzymes, cells are typically not permeable to the dye and after exposure to various enzymes, a portion of the population may become permeable. Results for selected enzymes on *C. vulgaris, Nannochloropsis*, and *S. capricornutum* are presented in Table 3.

TABLE 3

Percentage of population that becomes permeable after enzymatic treatment

| | *C. vulgaris* | | *Nannochloropsis* | | *Selenastrum* | |
|---|---|---|---|---|---|---|
| | % permeable | % permeable + lysozyme | % permeable | % permeable + lysozyme | % permeable | % permeable + lysozyme |
| no enzyme | 2.2 | — | 0.3 | — | 0.5 | — |
| sulfatase | 1.5 | 98.8 | 63.8 | 96.5 | 0.8 | 30.9 |
| β-glucuronidase | 2.6 | 54.1 | 0.3 | 6.2 | 1.3 | 2.7 |
| cellulase | 1.2 | 21.1 | 0.3 | 19.3 | 0.8 | 12.1 |
| lysozyme | 11.9 | — | 15 | — | 1.3 | — |
| lyticase | 1.09 | 48.4 | 0.2 | 37.8 | 1.6 | 61.3 |
| pectinase | 1.45 | 32.7 | 4.8 | 6.3 | 1.6 | 7.6 |
| trypsin | 0.9 | 29.9 | 0.6 | 68.7 | 1.6 | 9.2 |

The results of the cell permeabilization experiments suggest that a coating of chitodextrin (β-1-4 linked N-acetylglucosamine) or peptidoglycan (β-1-4 linked N-acetylmuramic acid and N-acetylglucosamine) type material, both polymers sensitive to lysozyme, surrounds or otherwise protects many of the other polymers from enzymatic attack. Lysozyme strips away or damages the outer layer, allowing other enzymes to act on the cell wall causing increased permeabilization. Treating *C. vulgaris* with lysozyme and sulfatase permeabilizes nearly 100% of the cells whereas with lysozyme alone, 12-15% of the population is permeabilized. Sulfatases hydrolyse O- and N-linked sulfate ester bonds suggesting that sulfated polymers are integral to cell wall architecture in *C. vulgaris*.

Some enzymes have a large effect on growing cells by inhibiting growth yet do not seem to have much effect on permeabilizing the cell walls of mature cells. As an example, cellulase and lyticase applied individually do not have much effect on growth. However, each in combination with lysozyme permeabilizes up to 20 and 40% of the *C. vulgaris* population respectively. These results suggest that algal cell wall sensitivities to enzymatic activities may change as the cell matures.

Figure 8:
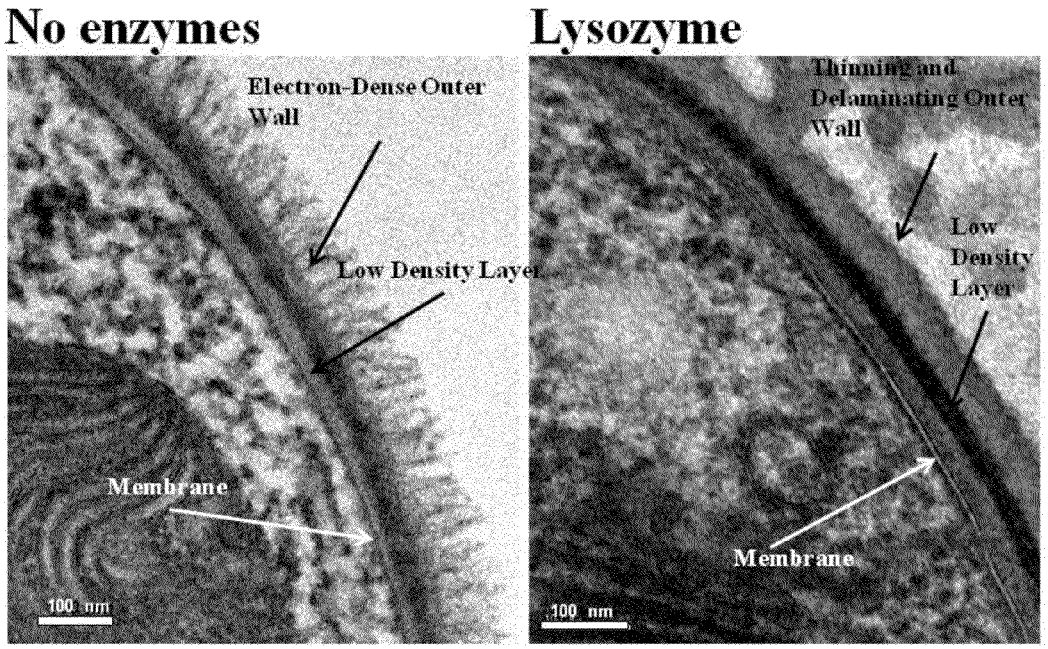
FIG. 8 shows transmission electron microscopy (TEM) images showing degradation of *C. vulgaris* cell walls by lysozyme.
Figure 9:
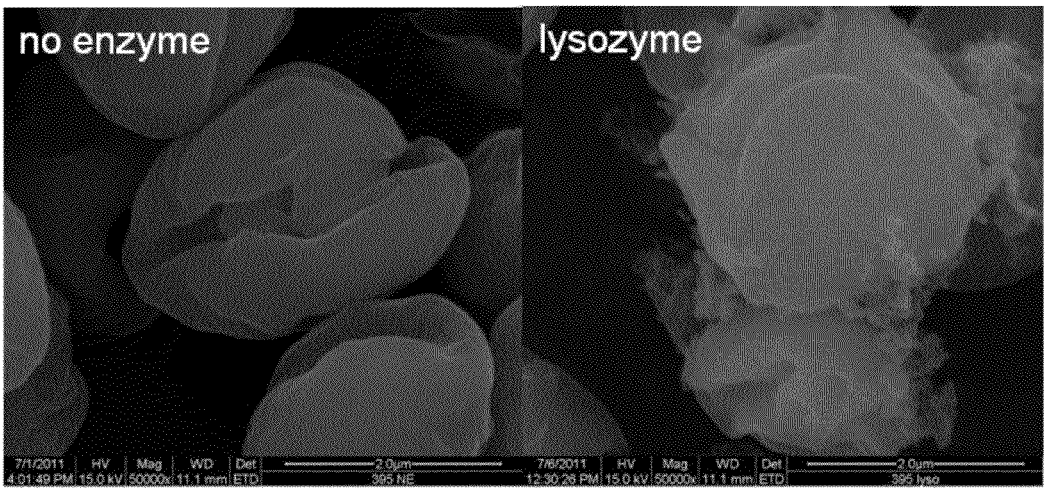
FIG. 9 shows scanning electron microscopy (SEM) images showing degradation of *C. vulgaris* cell walls by lysozyme.

Transmission and scanning electron microscopy may be used to directly visualize the effects of enzymes on algal cell walls. *C. vulgaris* cells were digested with various enzymes or combinations of enzymes and processed to yield images that display the action of these enzymes on the algal cells. For imaging analyses, thin sections of embedded algae were stained and visualized using transmission electron microscopy (TEM), producing images of the cell walls of algal cells under nitrogen replete and deplete (high lipid producing)

conditions. As shown in FIG. 8, TEM micrographs reveal the complete loss of the hair-like fiber layer of the outer wall surface, swelling of the outer layers, and a peeling or dissolution of material from the outer cell wall. It is typical for a complex, compact, layered cell wall to swell significantly as its internal cross-linked structure is weakened. FIG. 9 shows the same amorphous extracellular matrix from degradation of the cell wall using scanning electron microscopy (SEM). The cell wall does not need to be entirely digested to improve oil extraction.

Growth assays, permeabilization, and surface characterization studies may provide useful information on the types of linkages present and indicate how to functionally degrade the algal cell walls. Using the data from these experiments, a cocktail of enzymatic activities for efficient cell wall disruption can be created either from enzymes in-hand or through the mining of transcriptomic and proteomic datasets to provide sequence data on native enzymes possessing the desired enzymatic activity. Some native, intracellular cell wall degrading enzymes needed for cell division to partially degrade the algal cell wall have been described and may be suitable for use in the methods described herein. A combination of synergistic enzymatic activities may be needed to penetrate or weaken the cell wall sufficiently to enhance lipid extraction. Engineering an algal strain to reproduce a small number of additional enzymes will likely not pose much of a metabolic burden.

Production organisms may also be developed to allow the tightly controlled induction of cell-wall degrading enzymes. The genes encoding the enzymes of interest may be placed under the appropriate expression controls and stably transformed into the host organism. Native expression systems may be utilized to effectively express cell wall degrading enzymes in a green alga such as *C. vulgaris*. Particularly suitable are those that are tightly regulated and have a rapid, specific, and effective signal to induce high levels of expression. Inducible promoters responding to changes in pH, temperature, or the presence of an inducing chemical may be used to achieve internal, tightly controlled expression of cell wall degrading enzymes.

Enzymes isolated from cell-lytic organisms such as the PBCV-1 virus are also suitable for use in the methods described herein. Cell wall degrading enzymes from such viruses may be cloned and expressed in organisms such as *E. coli*. Enzymes purified from these organisms may be used to treat cells. The nucleotide and amino acid sequences of exemplary PBCV-1 cell degrading enzymes are disclosed in Table 1 and FIGS. 2-7.

In addition to exogenous enzymes, cells may express enzymes endogenously under appropriate expression controls such that regulated enzymatic degradation at an appropriate time can be achieved to facilitate economic lipid extraction from oil-rich algal cells. Nucleic acids encoding any of the enzymes described herein may be cloned, inserted into an appropriate expression vehicle, and inserted into the target cell. The nucleic acids may be expressed under the control of a constitutive or inducible promoter system. Such engineered cells may thus express the cell wall degrading enzymes constitutively or in response to an induction stimulus.

In certain embodiments, a nucleic acid may be identical to the sequence represented as SEQ ID NO:1, 3, 5, 7, 9, or 11. In other embodiments, the nucleic acids may be least about 80%, 81%, 82%, 83%, 84%, 85%, 86%, 87%, 88%, 89%, 90%, 91%, 92%, 93%, 94%, 95%, 96%, 97%, 98% or 99% identical to SEQ ID NO:1, 3, 5, 7, 9, or 11, or 80%, 81%, 82%, 83%, 84%, 85%, 86%, 87%, 88%, 89%, 90%, 91%, 92%, 93%, 94%, 95%, 96%, 97%, 98% or 99% identical to SEQ ID NO:1, 3, 5, 7, 9, or 11. Sequence identity calculations can be performed using computer programs, hybridization methods, or calculations. Exemplary computer program methods to determine identity and similarity between two sequences include, but are not limited to, the GCG program package, BLASTN, BLASTX, TBLASTX, and FASTA. The BLAST programs are publicly available from NCBI and other sources. For example, nucleotide sequence identity can be determined by comparing query sequences to sequences in publicly available sequence databases (NCBI) using the BLASTN2 algorithm.

The nucleic acid molecules exemplified herein encode PBCV-1 virus polypeptides with amino acid sequences represented by SEQ ID NO:2, 4, 6, 8, 10, and 12. In certain embodiments, the polypeptides may be at least about 80%, 81%, 82%, 83%, 84%, 85%, 86%, 87%, 88%, 89%, 90%, 91%, 92%, 93%, 94%, 95%, 96%, 97%, 98% or 99% identical to SEQ ID NO:2, 4, 6, 8, 10, and 12 and possess cell wall degrading function. The present disclosure encompasses algal cells such as *Chlorella* cells that contain the nucleic acid molecules described herein or express the polypeptides described herein.

Suitable vectors for gene expression may include (or may be derived from) plasmid vectors that are well known in the art, such as those commonly available from commercial sources. Vectors can contain one or more replication and inheritance systems for cloning or expression, one or more markers for selection in the host, and one or more expression cassettes. The inserted coding sequences can be synthesized by standard methods, isolated from natural sources, or prepared as hybrids. Ligation of the coding sequences to transcriptional regulatory elements or to other amino acid encoding sequences can be carried out using established methods. A large number of vectors, including algal, bacterial, yeast, and mammalian vectors, have been described for replication and/or expression in various host cells or cell-free systems, and may be used with genes encoding the enzymes described herein for simple cloning or protein expression.

Certain embodiments may employ algal promoters or regulatory operons. The efficiency of expression may be enhanced by the inclusion of enhancers that are appropriate for the particular cell system that is used, such as those described in the literature. Suitable promoters also include inducible algal promoters. Expression systems for constitutive expression in algal cells include, for example, the vector pCHLAMY1. Inducible expression systems include those such as pBAD24 (induced by the addition of arabinose) or IPTG inducible vectors. For algae, cold shock or other stress-induced (e.g., pH) promoters may be suitable. Other suitable inducible expression systems include those based on the nitrate reductase promoter from *Phaeodactylum tricornutum* (e.g., pPt-ApCAT) or the carbonic anhydrase promoter of *Dunaliella salina* (e.g., pMDDGN-Bar).

In exemplary embodiments, the host cell may be a microbial cell, such as a yeast cell or an algal cell, and may be from any genera or species of algae that is known to produce lipids or is genetically manipulable. Exemplary microorganisms include, but are not limited to, bacteria; fungi; archaea; protists; eukaryotes, such as a algae; and animals such as plankton, planarian, and amoeba Non-limiting examples of cells suitable for use include diatoms (bacillariophytes; including those from the genera *Amphipleura, Amphora, Chaetoceros, Cyclotella, Cymbella, Fragilaria, Hantzschia, Navicula, Nitzschia, Phaeodactylum* (e.g., *Phaeodactylum tricornutum* CCMP632), and *Thalassiosira*), green algae (chlorophytes; including those from the genera *Ankistrodesmus, Botryococcus, Chlorella, Chlorococcum, Dunaliella, Monoraphidium,*

*Oocystis* (e.g., *Oocystis pusilla* OOCYS1), *Scenedesmus*, and *Tetraselmis*), blue-green algae (cyanophytes; including those from the genera *Oscillatoria* and *Synechococcus*), golden-brown algae (chrysophytes; including those from the genera *Boekelovia*) and haptophytes (including those from the genera *Isochrysis* and *Pleurochrysis*). Additional examples include species from the genera *Ellipsoidon* (e.g., ELLIP1), *Franceia* (e.g., FRANC1), *Nannochloris* (e.g., NANNO2), *Nannochloropsis* (e.g., NANNP2), and *Selenastrum* (e.g., *S. capricornutum* UTEX1648). In certain embodiments, the cell is a *Chlorella vulgaris* cell, such as *Chlorella vulgaris* UTEX 395.

Host cells may be cultured in an appropriate fermentation medium. An appropriate, or effective, fermentation medium refers to any medium in which a host cell, including a genetically modified microorganism, when cultured, is capable of producing lipids. Such a medium is typically an aqueous medium comprising assimilable carbon, nitrogen and phosphate sources, but can also include appropriate salts, minerals, metals and other nutrients. Microorganisms and other cells can be cultured in conventional fermentation bioreactors or photobioreactors and by any fermentation process, including batch, fed-batch, cell recycle, and continuous fermentation. The pH of the fermentation medium is regulated to a pH suitable for growth of the particular organism. Culture media and conditions for various host cells are known in the art. A wide range of media for culturing algal cells, for example, are available from ATCC.

Algae may be grown in reservoir structures, such as ponds, troughs, or tubes, which are protected from the external environment and have controlled temperatures, atmospheres, and other conditions. Such reservoirs can also include a carbon dioxide source and a circulation mechanism. External reservoirs such as large ponds or captive marine environments may also be used. In one embodiment, a raceway pond can be used as an algae growth reservoir in which the algae is grown in shallow circulating ponds with constant movement around the raceway and constant extraction or skimming off of mature algae. Other examples of growth environments or reservoirs include bioreactors.

Isolation or extraction of lipids from the enzyme-degraded cells may be aided by mechanical processes such as crushing, for example, with an expeller or press, by supercritical fluid extraction, or the like. Once the lipids have been released from the cells, they can be recovered or separated from a slurry of debris material (such as cellular residue, enzyme, by-products, etc.). This can be done, for example, using techniques such as sedimentation or centrifugation. Recovered lipids can be collected and directed to a conversion process if desired.

One method of extracting lipids from cells that may be used with the cell wall degradation methods described above (or to extract lipids from any cell sample) is a solvent extraction using, for example, a mixture of a non-polar solvent (e.g., hexane) and a polar solvent (e.g., isopropanol). Exemplary non-polar solvents include liquid alkanes such as pentane, hexane, heptane, octane, nonane or decane, while exemplary polar solvents include alcohols such as ethanol, propanol, or butanol (including the iso-forms such as isopropanol and isobutanol). Solvents are typically mixed at ratios ranging from 1:1 to 5:4 (vol/vol), and the solvent mix ratios may be tested to ensure full single-phase mixing. As demonstrated in the Example below, such a solvent extraction increases the amount of lipids that may be extracted from enzyme-treated cells.

Cell slurries (for example, resulting from treatment of algal cells with cell wall degrading enzymes) may be mixed with solvents such as hexane and isopropanol for a period of time ranging from several minutes to several hours. The resulting solvent fraction may be separated from the solids fraction by, for example, centrifugation. Solvent phases may be separated by, for example, decanting or solvent aspiration. Lipids may then be isolated from the solvent fraction by removing the solvent and further purified or fractionated as desired. For example, lipids may be removed from the isolated solvent phase by vacuum distillation, allowing for recycling of the solvents for subsequent extractions, leaving behind the pure lipid fraction. Cell samples may be dewatered to alter the percentage of solids in the sample prior to the solvent extraction.

Solvent extraction may be carried out at any temperature within the range of 10° C. to 50° C. or at a temperature ranging from about 18° C. to 30° C. Exemplary temperatures include 10, 15, 20, 25, 30, 35, 40 45 or 50° C. In some embodiments, the solvent extraction is carried out at between 18° C. and 25° C., such as at 18, 19, 20, 21, 22, 23, 24 or 25° C.

The amount of time needed for the solvent extraction will vary with the sample size and other experimental parameters, but typically will range from 15 minutes to 12 hours. Exemplary times range from 30 minutes to 6 hours, such as 0.5, 1, 1.5, 2, 2.5, 3, 3.5, 4, 4.5, 5, 5.5, or 6 hours, or range from 1 to 4 hours. In certain embodiments, the solvent extraction is carried out for at least one hour or for less than 4 hours.

The percentage of solids in the cell suspension (e.g., aqueous algal or yeast cell suspension) used for the solvent extraction may vary from about 5% solids to about 90% solids, or from about 10% to about 40% solids. Examples include at least 5, 10, 15, 20, 25, 30, 35, or 40% solids.

The solvent used for the lipid extraction typically comprises a mixture of a non-polar solvent (e.g., hexane) and a polar solvent (e.g., isopropanol), but the relative volumes of the solvents can vary. Typically, the solvents may be used at any ratio of non-polar:polar solvent that generates a single phase solvent mixture. Exemplary ratios of hexane:isopropanol (volume to volume) are 1:1, 2:1, 2:3, 3:1, 3:2, 3:4, 3:5, 4:1, 4:3, 4:5, 5:1, 5:2, 5:3, or 5:4. The volume of solvent mix added to the cell slurry can range from about 0.5:1 to 3:1 and typically is 1:1.

The weakening or degrading of the cell walls may also serve as a form of "pretreatment" to the recalcitrant cell walls and thereby provide for easier use of the residual biomass post oil removal. The weakened algal cell walls may also be more permeable to DNA and may thus facilitate transformation of green algae. By making the cell walls weak and or completely digesting them, the cells are easy to break and the oils then become easy to collect. Treating with enzymes may also make the residual algal biomass easily fermentable in downstream processes.

EXAMPLE

Example 1

A 2 liter culture of *Chlorella vulgaris* UTEX 395 biomass was concentrated to 10% solids (dry weight basis) and 1.2 mg enzymes (combined 8 μg A94L, 206 μg A215L and 960 μg A292L) were added. This loading corresponds to 3 mg/g (enzyme/biomass), which is about 10-fold less enzyme per gram than is typically used for saccharification of cellulosic biomass. This mixture was tumbled end-over-end at room temperature (about 20° C.) for approximately 16 hours.

Triplicate samples of enzyme pretreated and untreated (control) aqueous algal biomass slurries (3 ml) were then extracted at room temperature with 3 ml of a 3:2 (v/v) hexane: isopropyl alcohol (H:IPA) mixture while stirring continuously for 2 hours with occasional manual shaking. Two fractions were generated: the H:IPA extractant fraction and the solid residue fraction. The two fractions were separated by transferring the samples into centrifuge compatible tubes and centrifuging at 11,000 rcf for 10 minutes. The subsequent fractions were then placed into pre-weighed glass vials. H:IPA fractions were immediately dried under nitrogen and transferred to a 40° C. vacuum oven for further drying. The solid residue was transferred quantitatively into pre-weighed vials, dried under nitrogen and transferred to a 40° C. vacuum oven for further drying.

After drying, the fractions were weighed and prepared for fatty acid methyl ester (FAME) analysis. A 10 mg sample was transferred into a pre-weighed 2 ml glass vial and the vials were dried in a 40° C. vacuum oven overnight before a final sample weight was recorded. The solid residue fractions were scraped down and homogenized and approximately 10 mg of sample was weighed out into a 2 ml glass vial. Samples were analyzed for fatty acid content through an in situ FAME determination (as detailed in Laurens et al., *Anal. Bioanal. Chem.*, 403:167-178 (2012)) in triplicate where fraction sizes were large enough.

Total lipid content in the original biomass sample was measured as total FAME, and this value was used to calculate the recovery of fatty acid fractionation in the process. Samples containing 7-10 mg of each freeze-dried sample were weighed out in triplicate and dried overnight in a 40° C. vacuum oven before a final weight was recorded. The resulting FAME content in each fraction was summed and normalized to the whole biomass introduced into the pretreatment experiment. The biomass in the reaction was estimated based on dissolved biomass estimates from triplicate experiments. The recovery of FAME calculation is based on a comparison of the sum of FAME in the fractions to the respective FAME content of the biomass from which they were derived.

The results presented in Table 4 illustrate a 7-8 fold increase in lipid extraction efficiency after enzyme treatment of *Chlorella* cells as compared to the control (untreated) cells.

TABLE 4

Lipid extraction efficiency in enzyme treated and control cells

| | Gravimetric extraction (% DW) | In-situ FAME extraction (% DW) | FAME in extracted cell residue (% DW) | Recovery (%) |
|---|---|---|---|---|
| Enzyme | 6.9 ± 1.8 | 5.6 ± 1.6 | 27.8 ± 2.7 | 89.3 ± 3 |
| Control | 1 ± 0.1 | 0.7 ± 0.1 | 31.6 ± 0.2 | 86.3 ± 0.3 |

A 7-fold increase in gravimetric extraction efficiency was observed, but not all gravimetrically extracted lipids are fatty acids useful for fuels. The fraction of fatty acids in lipids is likely a more accurate way to determine efficiency of extraction. The combination of FAME in extracted lipid allows us to determine the 'purity' of the lipids. The average percentage of fatty acids per lipids extracted after enzymatic treatment (81%+/−1.5%) was higher than in control cells (62.1%+/−1.4%) and thus the enzymatic treatment results in less interfering non-lipid components.

As shown in Table 5 below, the extracted lipids after enzyme treatment also have a FAME profile that is enriched in oleic acid (C18:1n9), which is often correlated with neutral lipids and indicates that the enzyme treatment selectively extracts more neutral lipids compared with the control.

TABLE 5

FAME profile in extracted oils relative to the whole biomass (reference)

| Fatty Acid | Enzyme | Control | Reference |
|---|---|---|---|
| C14:0 | 0.2 | 0.5 | 0.2 |
| C16:4 | 0.3 | 0.6 | 0.2 |
| C16:3 | 2.8 | 2.6 | 2.9 |
| C16:2 | 0.0 | 0.0 | 0.0 |
| C16:1n9 | 8.8 | 10.2 | 8.5 |
| C16:1n11 | 0.2 | 0.4 | 0.0 |
| C16 | 16.0 | 19.4 | 14.9 |
| C18:2 | 11.4 | 10.5 | 11.2 |
| C18:1n9 | 42.2 | 27.2 | 46.2 |
| C18:3 | 14.5 | 23.6 | 12.9 |
| C18:0 | 2.5 | 3.5 | 2.5 |
| C20:0 | 0.3 | 0.6 | 0.2 |
| C22:0 | 0.3 | 0.0 | 0.2 |
| C24 | 0.5 | 1.1 | 0.2 |

The Example discussed above is provided for purposes of illustration and is not intended to be limiting. Still other embodiments and modifications are also contemplated.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope.

SEQUENCE LISTING

```
<160> NUMBER OF SEQ ID NOS: 12

<210> SEQ ID NO 1
<211> LENGTH: 1092
<212> TYPE: DNA
<213> ORGANISM: Chlorella Virus PBCV-1
<220> FEATURE:
<221> NAME/KEY: CDS
<222> LOCATION: (1)..(1092)

<400> SEQUENCE: 1
```

-continued

```
atg tct caa gta gac acc gtg gta gac tcc gtg gta gac gtc gaa aac      48
Met Ser Gln Val Asp Thr Val Val Asp Ser Val Val Asp Val Glu Asn
1               5                   10                  15

cat cag ccc aca cat atc gac act ttc cca tac aat aaa cgg gtt att      96
His Gln Pro Thr His Ile Asp Thr Phe Pro Tyr Asn Lys Arg Val Ile
            20                  25                  30

gaa tct aaa ccc aaa aaa aat atg att gtc cgc ggt gtt gtt att tgc     144
Glu Ser Lys Pro Lys Lys Asn Met Ile Val Arg Gly Val Val Ile Cys
        35                  40                  45

atg gcg atc ctt att ttc ggg gga gca att gcc aca gca att gtg gtg     192
Met Ala Ile Leu Ile Phe Gly Gly Ala Ile Ala Thr Ala Ile Val Val
    50                  55                  60

agt tct gat aat tcc tca gac cag gcc cca gct cca gcg cca gga cca     240
Ser Ser Asp Asn Ser Ser Asp Gln Ala Pro Ala Pro Ala Pro Gly Pro
65                  70                  75                  80

gcc ctt att tac aaa ggc gcg tat att gac gaa cct ccg ccg ttt gaa     288
Ala Leu Ile Tyr Lys Gly Ala Tyr Ile Asp Glu Pro Pro Pro Phe Glu
                85                  90                  95

cca aag gct ggg ttt gaa gcc atg tgg tgg gat gag ttt gac ggc gaa     336
Pro Lys Ala Gly Phe Glu Ala Met Trp Trp Asp Glu Phe Asp Gly Glu
            100                 105                 110

gaa atc gac cgt aca aaa tgg tac atc cag ccc gat att gtt gat tat     384
Glu Ile Asp Arg Thr Lys Trp Tyr Ile Gln Pro Asp Ile Val Asp Tyr
        115                 120                 125

tat acc ggg aat aga cag att caa cat tat att gat tct cct tct aca     432
Tyr Thr Gly Asn Arg Gln Ile Gln His Tyr Ile Asp Ser Pro Ser Thr
    130                 135                 140

ata gaa gta tcc aac gat aca ctt cac att att gcc aat aac cct ggt     480
Ile Glu Val Ser Asn Asp Thr Leu His Ile Ile Ala Asn Asn Pro Gly
145                 150                 155                 160

gaa gtg caa tat aac gaa acc tcg agt aac tac gat caa aca tat tac     528
Glu Val Gln Tyr Asn Glu Thr Ser Ser Asn Tyr Asp Gln Thr Tyr Tyr
                165                 170                 175

act tca gcg cgc ata aac aca aaa aca act gga gga cat tgg tat ccg     576
Thr Ser Ala Arg Ile Asn Thr Lys Thr Thr Gly Gly His Trp Tyr Pro
            180                 185                 190

ggg atg gag gta aat ggt aca acg tgg aat acc att cga gta gag gcg     624
Gly Met Glu Val Asn Gly Thr Thr Trp Asn Thr Ile Arg Val Glu Ala
        195                 200                 205

cgg cta aag gcg ccg aga ggt ccg gga gtt gtc ggt gct ttt tgg atg     672
Arg Leu Lys Ala Pro Arg Gly Pro Gly Val Val Gly Ala Phe Trp Met
    210                 215                 220

cta cct att gac aat agt tgc ttc cca gaa att gat att ttt gag acg     720
Leu Pro Ile Asp Asn Ser Cys Phe Pro Glu Ile Asp Ile Phe Glu Thr
225                 230                 235                 240

cca tac tgc gaa aga gca tcc atg ggc acg tgg tac gta aac aaa gat     768
Pro Tyr Cys Glu Arg Ala Ser Met Gly Thr Trp Tyr Val Asn Lys Asp
                245                 250                 255

gtc cca aga ggt atc tca aag cat ggc acc acg atc acg gaa agt tat     816
Val Pro Arg Gly Ile Ser Lys His Gly Thr Thr Ile Thr Glu Ser Tyr
            260                 265                 270

gat aag ttt tgt gac gaa tac gtt aca tat gcc gtt gaa tgg aac gca     864
Asp Lys Phe Cys Asp Glu Tyr Val Thr Tyr Ala Val Glu Trp Asn Ala
        275                 280                 285

gat tat att gca ttt tat gcg ggt gac gct gaa acc ccg gtt ttt gtg     912
Asp Tyr Ile Ala Phe Tyr Ala Gly Asp Ala Glu Thr Pro Val Phe Val
    290                 295                 300

act gga aaa gaa atc tgg gct gga aaa tgc gat gca aac gat act gat     960
Thr Gly Lys Glu Ile Trp Ala Gly Lys Cys Asp Ala Asn Asp Thr Asp
305                 310                 315                 320
```

```
gca cct tac aac cga cct ttt tat att att ctg aat aca tct atc ggg     1008
Ala Pro Tyr Asn Arg Pro Phe Tyr Ile Ile Leu Asn Thr Ser Ile Gly
                325                 330                 335

tcc gca tgg ggc ggt atc cca ttg aat gat att ttc cct gca gtt cta     1056
Ser Ala Trp Gly Gly Ile Pro Leu Asn Asp Ile Phe Pro Ala Val Leu
            340                 345                 350

gac gta gac tac gtg cgg gtt tca ggc att cgc gat                     1092
Asp Val Asp Tyr Val Arg Val Ser Gly Ile Arg Asp
        355                 360


<210> SEQ ID NO 2
<211> LENGTH: 364
<212> TYPE: PRT
<213> ORGANISM: Chlorella Virus PBCV-1

<400> SEQUENCE: 2

Met Ser Gln Val Asp Thr Val Val Asp Ser Val Val Asp Val Glu Asn
1               5                   10                  15

His Gln Pro Thr His Ile Asp Thr Phe Pro Tyr Asn Lys Arg Val Ile
            20                  25                  30

Glu Ser Lys Pro Lys Lys Asn Met Ile Val Arg Gly Val Val Ile Cys
        35                  40                  45

Met Ala Ile Leu Ile Phe Gly Gly Ala Ile Ala Thr Ala Ile Val Val
    50                  55                  60

Ser Ser Asp Asn Ser Ser Asp Gln Ala Pro Ala Pro Ala Pro Gly Pro
65                  70                  75                  80

Ala Leu Ile Tyr Lys Gly Ala Tyr Ile Asp Glu Pro Pro Pro Phe Glu
                85                  90                  95

Pro Lys Ala Gly Phe Glu Ala Met Trp Trp Asp Glu Phe Asp Gly Glu
            100                 105                 110

Glu Ile Asp Arg Thr Lys Trp Tyr Ile Gln Pro Asp Ile Val Asp Tyr
        115                 120                 125

Tyr Thr Gly Asn Arg Gln Ile Gln His Tyr Ile Asp Ser Pro Ser Thr
    130                 135                 140

Ile Glu Val Ser Asn Asp Thr Leu His Ile Ile Ala Asn Asn Pro Gly
145                 150                 155                 160

Glu Val Gln Tyr Asn Glu Thr Ser Ser Asn Tyr Asp Gln Thr Tyr Tyr
                165                 170                 175

Thr Ser Ala Arg Ile Asn Thr Lys Thr Thr Gly Gly His Trp Tyr Pro
            180                 185                 190

Gly Met Glu Val Asn Gly Thr Thr Trp Asn Thr Ile Arg Val Glu Ala
        195                 200                 205

Arg Leu Lys Ala Pro Arg Gly Pro Gly Val Val Gly Ala Phe Trp Met
    210                 215                 220

Leu Pro Ile Asp Asn Ser Cys Phe Pro Glu Ile Asp Ile Phe Glu Thr
225                 230                 235                 240

Pro Tyr Cys Glu Arg Ala Ser Met Gly Thr Trp Tyr Val Asn Lys Asp
                245                 250                 255

Val Pro Arg Gly Ile Ser Lys His Gly Thr Thr Ile Thr Glu Ser Tyr
            260                 265                 270

Asp Lys Phe Cys Asp Glu Tyr Val Thr Tyr Ala Val Glu Trp Asn Ala
        275                 280                 285

Asp Tyr Ile Ala Phe Tyr Ala Gly Asp Ala Glu Thr Pro Val Phe Val
    290                 295                 300

Thr Gly Lys Glu Ile Trp Ala Gly Lys Cys Asp Ala Asn Asp Thr Asp
```

```
305                 310                 315                 320

Ala Pro Tyr Asn Arg Pro Phe Tyr Ile Ile Leu Asn Thr Ser Ile Gly
                325                 330                 335

Ser Ala Trp Gly Gly Ile Pro Leu Asn Asp Ile Phe Pro Ala Val Leu
            340                 345                 350

Asp Val Asp Tyr Val Arg Val Ser Gly Ile Arg Asp
        355                 360


<210> SEQ ID NO 3
<211> LENGTH: 3096
<212> TYPE: DNA
<213> ORGANISM: Chlorella Virus PBCV-1
<220> FEATURE:
<221> NAME/KEY: CDS
<222> LOCATION: (1)..(3096)

<400> SEQUENCE: 3

atg gga tcg tat ttt gtc cca ccg gcg aat tat ttt ttc aaa gat att       48
Met Gly Ser Tyr Phe Val Pro Pro Ala Asn Tyr Phe Phe Lys Asp Ile
1               5                   10                  15

ttc gcg tca aat gtt gga aac ata gca aac gta att ttt gat aac ggt       96
Phe Ala Ser Asn Val Gly Asn Ile Ala Asn Val Ile Phe Asp Asn Gly
            20                  25                  30

aat gtt ata gct gcc gga ggt ctt ggt tac tta ata ggt aac ggc gca      144
Asn Val Ile Ala Ala Gly Gly Leu Gly Tyr Leu Ile Gly Asn Gly Ala
        35                  40                  45

ttc atc acg gga gtc aca tca act gca ata gcg aac att cca gca gta      192
Phe Ile Thr Gly Val Thr Ser Thr Ala Ile Ala Asn Ile Pro Ala Val
    50                  55                  60

gtg acc gca gat atc cgc gga aat ctc atc ggt aac tac gcc aat gtc      240
Val Thr Ala Asp Ile Arg Gly Asn Leu Ile Gly Asn Tyr Ala Asn Val
65                  70                  75                  80

aac aat ata att gca tca tct gga aac atc tct aac gtc aga ttc gta      288
Asn Asn Ile Ile Ala Ser Ser Gly Asn Ile Ser Asn Val Arg Phe Val
                85                  90                  95

tcg ggt gga aac gtg acg gca tct tat tat ttc gga gat ggg tct cag      336
Ser Gly Gly Asn Val Thr Ala Ser Tyr Tyr Phe Gly Asp Gly Ser Gln
            100                 105                 110

ttg act ggt atc acc gcg act gct aat atc cca tcc ata gtg act gca      384
Leu Thr Gly Ile Thr Ala Thr Ala Asn Ile Pro Ser Ile Val Thr Ala
        115                 120                 125

gac atc cga ggt aac atc atc ggt aat tac gca aac gtc agc aac gta      432
Asp Ile Arg Gly Asn Ile Ile Gly Asn Tyr Ala Asn Val Ser Asn Val
    130                 135                 140

tct gca acc ttc gga aac atc gcg aac gtg ctg ttc aac aac ggt aat      480
Ser Ala Thr Phe Gly Asn Ile Ala Asn Val Leu Phe Asn Asn Gly Asn
145                 150                 155                 160

gtg acg gca gcg ggt ggt aac ggg ttc ttt ata gga aac gga tcg ctg      528
Val Thr Ala Ala Gly Gly Asn Gly Phe Phe Ile Gly Asn Gly Ser Leu
                165                 170                 175

ttg acc gga atc acc gcg act gct aat atc cca tcc ata gtg act gca      576
Leu Thr Gly Ile Thr Ala Thr Ala Asn Ile Pro Ser Ile Val Thr Ala
            180                 185                 190

gac atc cga ggt aac atc atc ggt aat tac gcc aac gtc agc aac gta      624
Asp Ile Arg Gly Asn Ile Ile Gly Asn Tyr Ala Asn Val Ser Asn Val
        195                 200                 205

tct gca acc ttc ggg aac atc gca aat gtg ttg ttc aac aac gga aac      672
Ser Ala Thr Phe Gly Asn Ile Ala Asn Val Leu Phe Asn Asn Gly Asn
    210                 215                 220

gta acg gca gcg ggt ggt aac ggg tac ttc ttc ggg aat ggg gcg ttg      720
```

-continued

```
Val Thr Ala Ala Gly Gly Asn Gly Tyr Phe Phe Gly Asn Gly Ala Leu
225                 230                 235                 240

ttg acc gga atc acc gcg act gct aat atc cca tcc ata gtg acc gca      768
Leu Thr Gly Ile Thr Ala Thr Ala Asn Ile Pro Ser Ile Val Thr Ala
                245                 250                 255

gac atc cga ggt aac atc atc ggt aat tac gcc aac gtc agc aac gta      816
Asp Ile Arg Gly Asn Ile Ile Gly Asn Tyr Ala Asn Val Ser Asn Val
            260                 265                 270

tct gca acc ttc ggg aac atc gca aat gtg ttg ttc aac aac gga aac      864
Ser Ala Thr Phe Gly Asn Ile Ala Asn Val Leu Phe Asn Asn Gly Asn
        275                 280                 285

gta acg gca gcg ggt ggt aac ggg tac ttc ttc ggg aat ggg gcg ttg      912
Val Thr Ala Ala Gly Gly Asn Gly Tyr Phe Phe Gly Asn Gly Ala Leu
    290                 295                 300

ttg acc gga atc acc gcg act gct aat atc cca tcc ata gtg act gca      960
Leu Thr Gly Ile Thr Ala Thr Ala Asn Ile Pro Ser Ile Val Thr Ala
305                 310                 315                 320

gac atc cgc gga aac atc atc ggt aac tac gcc aac gtc agc aac gta     1008
Asp Ile Arg Gly Asn Ile Ile Gly Asn Tyr Ala Asn Val Ser Asn Val
                325                 330                 335

tct gca acc ttc gga aac atc gcg aac gtg ttg ttc aat aat gga aac     1056
Ser Ala Thr Phe Gly Asn Ile Ala Asn Val Leu Phe Asn Asn Gly Asn
            340                 345                 350

gta acg gca gcg ggt ggt aat ggg ttc ttc atc gga aat ggg tcg ttg     1104
Val Thr Ala Ala Gly Gly Asn Gly Phe Phe Ile Gly Asn Gly Ser Leu
        355                 360                 365

ctg tct ggt atc acc gcg act gct aat ata cca tcc ata gtg act gca     1152
Leu Ser Gly Ile Thr Ala Thr Ala Asn Ile Pro Ser Ile Val Thr Ala
    370                 375                 380

gat atc cga ggt aac atc att ggc aac tat gca aac gtc agc aac gta     1200
Asp Ile Arg Gly Asn Ile Ile Gly Asn Tyr Ala Asn Val Ser Asn Val
385                 390                 395                 400

acg gca acg ttt gga aac atc gca aat gtg tta ttc aac aat gga aac     1248
Thr Ala Thr Phe Gly Asn Ile Ala Asn Val Leu Phe Asn Asn Gly Asn
                405                 410                 415

gta acg gca gcg ggt ggt aat ggt tat ttc ttc ggg aac ggg tcc cag     1296
Val Thr Ala Ala Gly Gly Asn Gly Tyr Phe Phe Gly Asn Gly Ser Gln
            420                 425                 430

ttg acc ggt gtc act gcc act tta cct tcc ata gta acc gca gac atc     1344
Leu Thr Gly Val Thr Ala Thr Leu Pro Ser Ile Val Thr Ala Asp Ile
        435                 440                 445

cgc gga aac atc att ggc aac tac gca aac gtc agc aac gta atc gca     1392
Arg Gly Asn Ile Ile Gly Asn Tyr Ala Asn Val Ser Asn Val Ile Ala
    450                 455                 460

acg ttc gga aac atc gca aat gtg tta ttc aac aat gga aac gta acg     1440
Thr Phe Gly Asn Ile Ala Asn Val Leu Phe Asn Asn Gly Asn Val Thr
465                 470                 475                 480

gca gcg gat ggc aat ggt tac ttc ttc ggg aat ggg tcc caa ttg acc     1488
Ala Ala Asp Gly Asn Gly Tyr Phe Phe Gly Asn Gly Ser Gln Leu Thr
                485                 490                 495

ggt gtc act gcc act tta cct tcc ata gta acc gca gac atc cgc gga     1536
Gly Val Thr Ala Thr Leu Pro Ser Ile Val Thr Ala Asp Ile Arg Gly
            500                 505                 510

aac atc att ggc aac tac gca aac gtc agc aac gta atc gca acg ttc     1584
Asn Ile Ile Gly Asn Tyr Ala Asn Val Ser Asn Val Ile Ala Thr Phe
        515                 520                 525

gga aac atc gca aat gtg tta ttc aac aat gga aac gta acg gca gcg     1632
Gly Asn Ile Ala Asn Val Leu Phe Asn Asn Gly Asn Val Thr Ala Ala
    530                 535                 540
```

-continued

```
ggt ggt aac ggt tac ttc ttc ggg aat ggg gcg ttg ttg acc gga atc     1680
Gly Gly Asn Gly Tyr Phe Phe Gly Asn Gly Ala Leu Leu Thr Gly Ile
545                 550                 555                 560

acc gcg act gct aat atc cca tcc ata gtg act gca gac atc cgc gga     1728
Thr Ala Thr Ala Asn Ile Pro Ser Ile Val Thr Ala Asp Ile Arg Gly
                565                 570                 575

aac atc att ggc aac tac gca aac gtc agc aac gta atc gca acg ttc     1776
Asn Ile Ile Gly Asn Tyr Ala Asn Val Ser Asn Val Ile Ala Thr Phe
            580                 585                 590

gga aac atc gca aat gtg tta ttc aac aat gga aac gta acg gca gcg     1824
Gly Asn Ile Ala Asn Val Leu Phe Asn Asn Gly Asn Val Thr Ala Ala
        595                 600                 605

gat ggc aat ggt tac ttc ttc ggg aat ggg tcc caa ttg acc ggt gtc     1872
Asp Gly Asn Gly Tyr Phe Phe Gly Asn Gly Ser Gln Leu Thr Gly Val
    610                 615                 620

act gcc act tta cct tcc ata gta acc gca gac atc cgc gga aac atc     1920
Thr Ala Thr Leu Pro Ser Ile Val Thr Ala Asp Ile Arg Gly Asn Ile
625                 630                 635                 640

att ggc aac tac gca aac gtc agc aac gta atc gca acg ttc gga aac     1968
Ile Gly Asn Tyr Ala Asn Val Ser Asn Val Ile Ala Thr Phe Gly Asn
                645                 650                 655

atc gca aat gtg tta ttc aac aat gga aac gta acg gca gcg ggt ggt     2016
Ile Ala Asn Val Leu Phe Asn Asn Gly Asn Val Thr Ala Ala Gly Gly
            660                 665                 670

aac ggt tac ttc ttc ggg aat ggg gcg ttg ttg acc gga atc acc gcg     2064
Asn Gly Tyr Phe Phe Gly Asn Gly Ala Leu Leu Thr Gly Ile Thr Ala
        675                 680                 685

act gct aat atc cca tcc ata gtg act gca gac atc cgc gga aac atc     2112
Thr Ala Asn Ile Pro Ser Ile Val Thr Ala Asp Ile Arg Gly Asn Ile
    690                 695                 700

atc ggt aat tac gca aac gtc agc aac gta acg gca acg ttc gga aac     2160
Ile Gly Asn Tyr Ala Asn Val Ser Asn Val Thr Ala Thr Phe Gly Asn
705                 710                 715                 720

atc gcg aac gtg ttg ttc aac aac gga aac gtg acg gca gcg ggt ggt     2208
Ile Ala Asn Val Leu Phe Asn Asn Gly Asn Val Thr Ala Ala Gly Gly
                725                 730                 735

aat ggt tat ttc ttc ggg aac ggg tcc cag ttg acc ggt gtc act gcc     2256
Asn Gly Tyr Phe Phe Gly Asn Gly Ser Gln Leu Thr Gly Val Thr Ala
            740                 745                 750

act tta cct tct ata gta acc gca gac atc cgc gga aac atc atc ggt     2304
Thr Leu Pro Ser Ile Val Thr Ala Asp Ile Arg Gly Asn Ile Ile Gly
        755                 760                 765

aac tac gca aac gtt agc aac gta atc gca acc ttt ggg aac atc gcg     2352
Asn Tyr Ala Asn Val Ser Asn Val Ile Ala Thr Phe Gly Asn Ile Ala
    770                 775                 780

aac gtg ttg ttc aat aat gga aac gta acg gca gcg ggt ggt aac ggg     2400
Asn Val Leu Phe Asn Asn Gly Asn Val Thr Ala Ala Gly Gly Asn Gly
785                 790                 795                 800

tac ttc ttc ggg aat ggg gcg ttg ttg acc gga atc acc gcg act gct     2448
Tyr Phe Phe Gly Asn Gly Ala Leu Leu Thr Gly Ile Thr Ala Thr Ala
                805                 810                 815

aat ata cct tct ata gtg act gca gac att cga ggt aac atc atc ggt     2496
Asn Ile Pro Ser Ile Val Thr Ala Asp Ile Arg Gly Asn Ile Ile Gly
            820                 825                 830

aac tat gcc aac gtc agc aac gta acg gca acc ttc gga aac atc gga     2544
Asn Tyr Ala Asn Val Ser Asn Val Thr Ala Thr Phe Gly Asn Ile Gly
        835                 840                 845

aac gtg ctg ttc aac aac ggt aac gta act gca gca ggc ggt aac ggg     2592
Asn Val Leu Phe Asn Asn Gly Asn Val Thr Ala Ala Gly Gly Asn Gly
    850                 855                 860
```

```
tac ttc ttc gga aac gga act ttc ctc aac ttt tcc act ata act gcc     2640
Tyr Phe Phe Gly Asn Gly Thr Phe Leu Asn Phe Ser Thr Ile Thr Ala
865                 870                 875                 880

gat atc cgc ggg aac atc ata ggc aac tat gca aac gtc ggg aac gtt     2688
Asp Ile Arg Gly Asn Ile Ile Gly Asn Tyr Ala Asn Val Gly Asn Val
                885                 890                 895

att gca ggt aac gta tca aca acc ctc gga aac atc gga aac gtg ctg     2736
Ile Ala Gly Asn Val Ser Thr Thr Leu Gly Asn Ile Gly Asn Val Leu
            900                 905                 910

ttc aac aac ggt aac gta acg gca gca ggc ggt aac ggg tac ttc ttt     2784
Phe Asn Asn Gly Asn Val Thr Ala Ala Gly Gly Asn Gly Tyr Phe Phe
        915                 920                 925

gga aat ggt acc tca ctc act ttt tct acg ata aga gct gat att cgc     2832
Gly Asn Gly Thr Ser Leu Thr Phe Ser Thr Ile Arg Ala Asp Ile Arg
    930                 935                 940

gga aat atc att ggt aat tat gcc aac gtt gca aac gtg atc gcg ggt     2880
Gly Asn Ile Ile Gly Asn Tyr Ala Asn Val Ala Asn Val Ile Ala Gly
945                 950                 955                 960

aat gtc aac tca acc ttt gga aac atc gct ggt gtt aca ttt gac gct     2928
Asn Val Asn Ser Thr Phe Gly Asn Ile Ala Gly Val Thr Phe Asp Ala
                965                 970                 975

gga aac gta tca tcg ccc gtg gac att ttg gtg tct ggt aat gta tct     2976
Gly Asn Val Ser Ser Pro Val Asp Ile Leu Val Ser Gly Asn Val Ser
            980                 985                 990

gta ggt tct gat gga tta ttc aga  ggt cca act aac caa  tca aac aat   3024
Val Gly Ser Asp Gly Leu Phe Arg  Gly Pro Thr Asn Gln  Ser Asn Asn
        995                 1000                1005

gca cta  att tta aga ggt att  gga ggt aca aac act  gtt aat ctg      3069
Ala Leu  Ile Leu Arg Gly Ile  Gly Gly Thr Asn Thr  Val Asn Leu
    1010                1015                1020

ttc agt  ata ggt gct cct tcg  ggt cag                               3096
Phe Ser  Ile Gly Ala Pro Ser  Gly Gln
    1025                1030


<210> SEQ ID NO 4
<211> LENGTH: 1032
<212> TYPE: PRT
<213> ORGANISM: Chlorella Virus PBCV-1

<400> SEQUENCE: 4

Met Gly Ser Tyr Phe Val Pro Pro Ala Asn Tyr Phe Phe Lys Asp Ile
1               5                   10                  15

Phe Ala Ser Asn Val Gly Asn Ile Ala Asn Val Ile Phe Asp Asn Gly
            20                  25                  30

Asn Val Ile Ala Ala Gly Gly Leu Gly Tyr Leu Ile Gly Asn Gly Ala
        35                  40                  45

Phe Ile Thr Gly Val Thr Ser Thr Ala Ile Ala Asn Ile Pro Ala Val
    50                  55                  60

Val Thr Ala Asp Ile Arg Gly Asn Leu Ile Gly Asn Tyr Ala Asn Val
65                  70                  75                  80

Asn Asn Ile Ile Ala Ser Ser Gly Asn Ile Ser Asn Val Arg Phe Val
                85                  90                  95

Ser Gly Gly Asn Val Thr Ala Ser Tyr Tyr Phe Gly Asp Gly Ser Gln
            100                 105                 110

Leu Thr Gly Ile Thr Ala Thr Ala Asn Ile Pro Ser Ile Val Thr Ala
        115                 120                 125

Asp Ile Arg Gly Asn Ile Ile Gly Asn Tyr Ala Asn Val Ser Asn Val
    130                 135                 140
```

```
Ser Ala Thr Phe Gly Asn Ile Ala Asn Val Leu Phe Asn Asn Gly Asn
145                 150                 155                 160

Val Thr Ala Ala Gly Gly Asn Gly Phe Phe Ile Gly Asn Gly Ser Leu
                165                 170                 175

Leu Thr Gly Ile Thr Ala Thr Ala Asn Ile Pro Ser Ile Val Thr Ala
            180                 185                 190

Asp Ile Arg Gly Asn Ile Ile Gly Asn Tyr Ala Asn Val Ser Asn Val
        195                 200                 205

Ser Ala Thr Phe Gly Asn Ile Ala Asn Val Leu Phe Asn Asn Gly Asn
    210                 215                 220

Val Thr Ala Ala Gly Gly Asn Gly Tyr Phe Phe Gly Asn Gly Ala Leu
225                 230                 235                 240

Leu Thr Gly Ile Thr Ala Thr Ala Asn Ile Pro Ser Ile Val Thr Ala
                245                 250                 255

Asp Ile Arg Gly Asn Ile Ile Gly Asn Tyr Ala Asn Val Ser Asn Val
            260                 265                 270

Ser Ala Thr Phe Gly Asn Ile Ala Asn Val Leu Phe Asn Asn Gly Asn
        275                 280                 285

Val Thr Ala Ala Gly Gly Asn Gly Tyr Phe Phe Gly Asn Gly Ala Leu
    290                 295                 300

Leu Thr Gly Ile Thr Ala Thr Ala Asn Ile Pro Ser Ile Val Thr Ala
305                 310                 315                 320

Asp Ile Arg Gly Asn Ile Ile Gly Asn Tyr Ala Asn Val Ser Asn Val
                325                 330                 335

Ser Ala Thr Phe Gly Asn Ile Ala Asn Val Leu Phe Asn Asn Gly Asn
            340                 345                 350

Val Thr Ala Ala Gly Gly Asn Gly Phe Phe Ile Gly Asn Gly Ser Leu
        355                 360                 365

Leu Ser Gly Ile Thr Ala Thr Ala Asn Ile Pro Ser Ile Val Thr Ala
    370                 375                 380

Asp Ile Arg Gly Asn Ile Ile Gly Asn Tyr Ala Asn Val Ser Asn Val
385                 390                 395                 400

Thr Ala Thr Phe Gly Asn Ile Ala Asn Val Leu Phe Asn Asn Gly Asn
                405                 410                 415

Val Thr Ala Ala Gly Gly Asn Gly Tyr Phe Phe Gly Asn Gly Ser Gln
            420                 425                 430

Leu Thr Gly Val Thr Ala Thr Leu Pro Ser Ile Val Thr Ala Asp Ile
        435                 440                 445

Arg Gly Asn Ile Ile Gly Asn Tyr Ala Asn Val Ser Asn Val Ile Ala
    450                 455                 460

Thr Phe Gly Asn Ile Ala Asn Val Leu Phe Asn Asn Gly Asn Val Thr
465                 470                 475                 480

Ala Ala Asp Gly Asn Gly Tyr Phe Phe Gly Asn Gly Ser Gln Leu Thr
                485                 490                 495

Gly Val Thr Ala Thr Leu Pro Ser Ile Val Thr Ala Asp Ile Arg Gly
            500                 505                 510

Asn Ile Ile Gly Asn Tyr Ala Asn Val Ser Asn Val Ile Ala Thr Phe
        515                 520                 525

Gly Asn Ile Ala Asn Val Leu Phe Asn Asn Gly Asn Val Thr Ala Ala
    530                 535                 540

Gly Gly Asn Gly Tyr Phe Phe Gly Asn Gly Ala Leu Leu Thr Gly Ile
545                 550                 555                 560
```

```
Thr Ala Thr Ala Asn Ile Pro Ser Ile Val Thr Ala Asp Ile Arg Gly
                565                 570                 575

Asn Ile Ile Gly Asn Tyr Ala Asn Val Ser Asn Val Ile Ala Thr Phe
            580                 585                 590

Gly Asn Ile Ala Asn Val Leu Phe Asn Asn Gly Asn Val Thr Ala Ala
        595                 600                 605

Asp Gly Asn Gly Tyr Phe Phe Gly Asn Gly Ser Gln Leu Thr Gly Val
    610                 615                 620

Thr Ala Thr Leu Pro Ser Ile Val Thr Ala Asp Ile Arg Gly Asn Ile
625                 630                 635                 640

Ile Gly Asn Tyr Ala Asn Val Ser Asn Val Ile Ala Thr Phe Gly Asn
                645                 650                 655

Ile Ala Asn Val Leu Phe Asn Asn Gly Asn Val Thr Ala Ala Gly Gly
            660                 665                 670

Asn Gly Tyr Phe Phe Gly Asn Gly Ala Leu Leu Thr Gly Ile Thr Ala
        675                 680                 685

Thr Ala Asn Ile Pro Ser Ile Val Thr Ala Asp Ile Arg Gly Asn Ile
    690                 695                 700

Ile Gly Asn Tyr Ala Asn Val Ser Asn Val Thr Ala Thr Phe Gly Asn
705                 710                 715                 720

Ile Ala Asn Val Leu Phe Asn Asn Gly Asn Val Thr Ala Ala Gly Gly
                725                 730                 735

Asn Gly Tyr Phe Phe Gly Asn Gly Ser Gln Leu Thr Gly Val Thr Ala
            740                 745                 750

Thr Leu Pro Ser Ile Val Thr Ala Asp Ile Arg Gly Asn Ile Ile Gly
        755                 760                 765

Asn Tyr Ala Asn Val Ser Asn Val Ile Ala Thr Phe Gly Asn Ile Ala
    770                 775                 780

Asn Val Leu Phe Asn Asn Gly Asn Val Thr Ala Ala Gly Gly Asn Gly
785                 790                 795                 800

Tyr Phe Phe Gly Asn Gly Ala Leu Leu Thr Gly Ile Thr Ala Thr Ala
                805                 810                 815

Asn Ile Pro Ser Ile Val Thr Ala Asp Ile Arg Gly Asn Ile Ile Gly
            820                 825                 830

Asn Tyr Ala Asn Val Ser Asn Val Thr Ala Thr Phe Gly Asn Ile Gly
        835                 840                 845

Asn Val Leu Phe Asn Asn Gly Asn Val Thr Ala Ala Gly Gly Asn Gly
    850                 855                 860

Tyr Phe Phe Gly Asn Gly Thr Phe Leu Asn Phe Ser Thr Ile Thr Ala
865                 870                 875                 880

Asp Ile Arg Gly Asn Ile Ile Gly Asn Tyr Ala Asn Val Gly Asn Val
                885                 890                 895

Ile Ala Gly Asn Val Ser Thr Thr Leu Gly Asn Ile Gly Asn Val Leu
            900                 905                 910

Phe Asn Asn Gly Asn Val Thr Ala Ala Gly Gly Asn Gly Tyr Phe Phe
        915                 920                 925

Gly Asn Gly Thr Ser Leu Thr Phe Ser Thr Ile Arg Ala Asp Ile Arg
    930                 935                 940

Gly Asn Ile Ile Gly Asn Tyr Ala Asn Val Ala Asn Val Ile Ala Gly
945                 950                 955                 960

Asn Val Asn Ser Thr Phe Gly Asn Ile Ala Gly Val Thr Phe Asp Ala
                965                 970                 975

Gly Asn Val Ser Ser Pro Val Asp Ile Leu Val Ser Gly Asn Val Ser
```

```
            980                 985                 990

Val Gly Ser Asp Gly Leu Phe Arg  Gly Pro Thr Asn Gln  Ser Asn Asn
        995                 1000                1005

Ala Leu  Ile Leu Arg Gly Ile  Gly Gly Thr Asn Thr  Val Asn Leu
    1010                1015                1020

Phe Ser  Ile Gly Ala Pro Ser  Gly Gln
    1025                1030


<210> SEQ ID NO 5
<211> LENGTH: 2490
<212> TYPE: DNA
<213> ORGANISM: Chlorella Virus PBCV-1
<220> FEATURE:
<221> NAME/KEY: CDS
<222> LOCATION: (1)..(2490)

<400> SEQUENCE: 5

atg gcg acc gta cca agc aca aaa ctc gaa tta acc gtt tct aaa aca       48
Met Ala Thr Val Pro Ser Thr Lys Leu Glu Leu Thr Val Ser Lys Thr
1               5                   10                  15

tcc gac tgg aat acc gga tat gac gga caa ttc aaa ctt gaa aac aag       96
Ser Asp Trp Asn Thr Gly Tyr Asp Gly Gln Phe Lys Leu Glu Asn Lys
            20                  25                  30

aat gat tat gat att ctt caa tgg ggg atg aca ttt gat ttt cct gaa      144
Asn Asp Tyr Asp Ile Leu Gln Trp Gly Met Thr Phe Asp Phe Pro Glu
        35                  40                  45

tct gaa aac ttt aca tgg ttc agc gaa ggc gac ctt gtt cgt aag ggt      192
Ser Glu Asn Phe Thr Trp Phe Ser Glu Gly Asp Leu Val Arg Lys Gly
    50                  55                  60

aac aag gtg act atg ata cca aaa gat tgg aac atg tca att ccc gcg      240
Asn Lys Val Thr Met Ile Pro Lys Asp Trp Asn Met Ser Ile Pro Ala
65                  70                  75                  80

gga acg acg aaa atc ata cct ttt gga ggt gtg aaa gct ctc cct gga      288
Gly Thr Thr Lys Ile Ile Pro Phe Gly Gly Val Lys Ala Leu Pro Gly
                85                  90                  95

aat ctt aaa tac aac caa atc cta cca ctc gta ggt aag gat cct tct      336
Asn Leu Lys Tyr Asn Gln Ile Leu Pro Leu Val Gly Lys Asp Pro Ser
            100                 105                 110

ttg gca aaa aga ggt aaa tgg tct tct aaa gcc gta gcc ccg tac gta      384
Leu Ala Lys Arg Gly Lys Trp Ser Ser Lys Ala Val Ala Pro Tyr Val
        115                 120                 125

gac gct tgt gct ttc cca act cca gat ctc ccc gcg atc agt aaa gca      432
Asp Ala Cys Ala Phe Pro Thr Pro Asp Leu Pro Ala Ile Ser Lys Ala
    130                 135                 140

agc gga ctg aaa ttc ttt act ctt gcg ttt atc act gct gac agc aat      480
Ser Gly Leu Lys Phe Phe Thr Leu Ala Phe Ile Thr Ala Asp Ser Asn
145                 150                 155                 160

aac aaa gcg agc tgg gcg gga act atc cct cta tcg agt cag cat ctt      528
Asn Lys Ala Ser Trp Ala Gly Thr Ile Pro Leu Ser Ser Gln His Leu
                165                 170                 175

cta tcc cag gtg cgc caa atc aga agt tct gga ggt gat att tct att      576
Leu Ser Gln Val Arg Gln Ile Arg Ser Ser Gly Gly Asp Ile Ser Ile
            180                 185                 190

tcg ttc ggc ggt gca aac ggt ata gaa ctt gcg gat gct att aag gac      624
Ser Phe Gly Gly Ala Asn Gly Ile Glu Leu Ala Asp Ala Ile Lys Asp
        195                 200                 205

gtt gac gct ctt gta gcc gag tat agt aga gta atc gac ttg tat tct      672
Val Asp Ala Leu Val Ala Glu Tyr Ser Arg Val Ile Asp Leu Tyr Ser
    210                 215                 220

ctg aca cgt att gac ttt gat atc gaa ggt ggt gcg gtc gct gat acc      720
```

-continued

```
Leu Thr Arg Ile Asp Phe Asp Ile Glu Gly Gly Ala Val Ala Asp Thr
225                 230                 235                 240

gaa gga gtt gac aga cgt aac aaa gct atc aat atc ttg aac aag aag      768
Glu Gly Val Asp Arg Arg Asn Lys Ala Ile Asn Ile Leu Asn Lys Lys
                245                 250                 255

tac cct aat ttg caa ata aca tac tgt ctc ccc gtg tta cca aca gga      816
Tyr Pro Asn Leu Gln Ile Thr Tyr Cys Leu Pro Val Leu Pro Thr Gly
            260                 265                 270

ctt gct ctc gcg ggt gaa ctc ctg gtg cgc aat gcc aga gtg aac aat      864
Leu Ala Leu Ala Gly Glu Leu Leu Val Arg Asn Ala Arg Val Asn Asn
        275                 280                 285

gct ata ata cat tca ttc aac ggt atg tca atg gat ttt gga gat tcc      912
Ala Ile Ile His Ser Phe Asn Gly Met Ser Met Asp Phe Gly Asp Ser
    290                 295                 300

gcg gct cct gac ccg gaa ggt cgt atg gga gat tat gta ata atg tct      960
Ala Ala Pro Asp Pro Glu Gly Arg Met Gly Asp Tyr Val Ile Met Ser
305                 310                 315                 320

tgt caa aac ctt cga acc caa gtt ttg tcc gct ggg tat gat tct cca     1008
Cys Gln Asn Leu Arg Thr Gln Val Leu Ser Ala Gly Tyr Asp Ser Pro
                325                 330                 335

aac ata gga acc att cct atg atc gga gtt aac gac gta gag agt gaa     1056
Asn Ile Gly Thr Ile Pro Met Ile Gly Val Asn Asp Val Glu Ser Glu
            340                 345                 350

gtg ttc aga att tct gac gca aag aag gtg tat gat ttc ttc cag agc     1104
Val Phe Arg Ile Ser Asp Ala Lys Lys Val Tyr Asp Phe Phe Gln Ser
        355                 360                 365

atc ccc tgg atg acc tat gtc ggt ttt tgg tcc aca aat cgc gac aat     1152
Ile Pro Trp Met Thr Tyr Val Gly Phe Trp Ser Thr Asn Arg Asp Asn
    370                 375                 380

gca ggc cag ggt caa ggt gcc aac cca ttc aat tcg ggt ata aaa caa     1200
Ala Gly Gln Gly Gln Gly Ala Asn Pro Phe Asn Ser Gly Ile Lys Gln
385                 390                 395                 400

aac ccg tat gac ttt agt aaa act ttc ctc gga aag aaa gta ctc gaa     1248
Asn Pro Tyr Asp Phe Ser Lys Thr Phe Leu Gly Lys Lys Val Leu Glu
                405                 410                 415

tta gac ccc agt cct aga cca aac ccc cct cat atc cca ccc cct ggt     1296
Leu Asp Pro Ser Pro Arg Pro Asn Pro Pro His Ile Pro Pro Pro Gly
            420                 425                 430

gga gat cct aac cca ctt cca ccc gta ggc ccc gtt gat ccc agt cct     1344
Gly Asp Pro Asn Pro Leu Pro Pro Val Gly Pro Val Asp Pro Ser Pro
        435                 440                 445

aaa cct cct acg ccg aaa cct ccc aca cca aat cct cct acc aat cct     1392
Lys Pro Pro Thr Pro Lys Pro Pro Thr Pro Asn Pro Pro Thr Asn Pro
    450                 455                 460

gaa aaa ccc cag aaa cca gtt cag aaa ccg aat gtg aac gca gat tgg     1440
Glu Lys Pro Gln Lys Pro Val Gln Lys Pro Asn Val Asn Ala Asp Trp
465                 470                 475                 480

tgc aac gtg tct ctc gaa ttc gta cgc agg tgt cgt gac ggc gaa gcc     1488
Cys Asn Val Ser Leu Glu Phe Val Arg Arg Cys Arg Asp Gly Glu Ala
                485                 490                 495

cct gat gca gta att aag gat ctt caa aca aga tat tct ggc ctg ggt     1536
Pro Asp Ala Val Ile Lys Asp Leu Gln Thr Arg Tyr Ser Gly Leu Gly
            500                 505                 510

ccg gaa aat cag aag gcc ctc aag aaa ctt ctt gac ccc tca aag ccc     1584
Pro Glu Asn Gln Lys Ala Leu Lys Lys Leu Leu Asp Pro Ser Lys Pro
        515                 520                 525

gtt gac cct aaa ccc gtt gac cct aaa ccc gtt gac cct aaa ccc gtt     1632
Val Asp Pro Lys Pro Val Asp Pro Lys Pro Val Asp Pro Lys Pro Val
    530                 535                 540
```

```
gac cct aaa cca cct gtt aaa agc aat cga ttt ttc aca cca tac aca     1680
Asp Pro Lys Pro Pro Val Lys Ser Asn Arg Phe Phe Thr Pro Tyr Thr
545                 550                 555                 560

gag tct tgg caa tat tgg agt ggg tgg aac aat gcc aag act cta gaa     1728
Glu Ser Trp Gln Tyr Trp Ser Gly Trp Asn Asn Ala Lys Thr Leu Glu
                565                 570                 575

caa att cca aca aag aac gtg act ctt gca ttc gta tta tac gcc gat     1776
Gln Ile Pro Thr Lys Asn Val Thr Leu Ala Phe Val Leu Tyr Ala Asp
            580                 585                 590

ggt gtt cct aag ttc gac ggg act atg gac gcg aat att tat gtt gac     1824
Gly Val Pro Lys Phe Asp Gly Thr Met Asp Ala Asn Ile Tyr Val Asp
        595                 600                 605

cag gcg aaa ata gtc cag act aag ggc gga atc gtc cgt att tct ttc     1872
Gln Ala Lys Ile Val Gln Thr Lys Gly Gly Ile Val Arg Ile Ser Phe
    610                 615                 620

ggt ggt gcc act gga act gaa cta gca ctc ggt atc aaa gac gta aac     1920
Gly Gly Ala Thr Gly Thr Glu Leu Ala Leu Gly Ile Lys Asp Val Asn
625                 630                 635                 640

aaa ctt gct gct gca tat gaa agc gtc ata aag atg tac aat acc aga     1968
Lys Leu Ala Ala Ala Tyr Glu Ser Val Ile Lys Met Tyr Asn Thr Arg
                645                 650                 655

aat att gat atg gac atc gaa gga ggc ccc gct tct gac atg gat agt     2016
Asn Ile Asp Met Asp Ile Glu Gly Gly Pro Ala Ser Asp Met Asp Ser
            660                 665                 670

atc act cgt aga aac aag gcg ctt gtc att ttg caa aag aag tat cca     2064
Ile Thr Arg Arg Asn Lys Ala Leu Val Ile Leu Gln Lys Lys Tyr Pro
        675                 680                 685

gat ttg aaa gtc gac tat act ctc gcg gtg atg caa aca ggt ctt tcc     2112
Asp Leu Lys Val Asp Tyr Thr Leu Ala Val Met Gln Thr Gly Leu Ser
    690                 695                 700

act cag gga ttg gat atc ctg aag gat gcg aaa aaa caa ggt cta aaa     2160
Thr Gln Gly Leu Asp Ile Leu Lys Asp Ala Lys Lys Gln Gly Leu Lys
705                 710                 715                 720

gtc cac gca gtg aat atc atg gct atg gac tat ggc act aat gaa aaa     2208
Val His Ala Val Asn Ile Met Ala Met Asp Tyr Gly Thr Asn Glu Lys
                725                 730                 735

caa atg gga aaa gca gcg atc agt gcc gct act gca acg aag aag cag     2256
Gln Met Gly Lys Ala Ala Ile Ser Ala Ala Thr Ala Thr Lys Lys Gln
            740                 745                 750

tgt gat gac ttg ggc ctc gtt tat gaa ggt gtg ggc atc acc ccg atg     2304
Cys Asp Asp Leu Gly Leu Val Tyr Glu Gly Val Gly Ile Thr Pro Met
        755                 760                 765

atc ggt cta aac gac aca tct ccg gaa aca ttt act att gat aac gcc     2352
Ile Gly Leu Asn Asp Thr Ser Pro Glu Thr Phe Thr Ile Asp Asn Ala
    770                 775                 780

aag gaa gtc gtc gat ttc gca aag aaa acg tct tgg gta aat ttc ttg     2400
Lys Glu Val Val Asp Phe Ala Lys Lys Thr Ser Trp Val Asn Phe Leu
785                 790                 795                 800

gga ttt tgg gcg acc ggg cgt gac aat gcc aaa gat acc aaa gtt aag     2448
Gly Phe Trp Ala Thr Gly Arg Asp Asn Ala Lys Asp Thr Lys Val Lys
                805                 810                 815

caa gtg atg tgg gaa ttc aca aat ata ttc aac aca ttt gcg             2490
Gln Val Met Trp Glu Phe Thr Asn Ile Phe Asn Thr Phe Ala
            820                 825                 830
```

<210> SEQ ID NO 6
<211> LENGTH: 830
<212> TYPE: PRT
<213> ORGANISM: Chlorella Virus PBCV-1

<400> SEQUENCE: 6

```
Met Ala Thr Val Pro Ser Thr Lys Leu Glu Leu Thr Val Ser Lys Thr
1               5                   10                  15

Ser Asp Trp Asn Thr Gly Tyr Asp Gly Gln Phe Lys Leu Glu Asn Lys
            20                  25                  30

Asn Asp Tyr Asp Ile Leu Gln Trp Gly Met Thr Phe Asp Phe Pro Glu
        35                  40                  45

Ser Glu Asn Phe Thr Trp Phe Ser Glu Gly Asp Leu Val Arg Lys Gly
    50                  55                  60

Asn Lys Val Thr Met Ile Pro Lys Asp Trp Asn Met Ser Ile Pro Ala
65                  70                  75                  80

Gly Thr Thr Lys Ile Ile Pro Phe Gly Gly Val Lys Ala Leu Pro Gly
                85                  90                  95

Asn Leu Lys Tyr Asn Gln Ile Leu Pro Leu Val Gly Lys Asp Pro Ser
            100                 105                 110

Leu Ala Lys Arg Gly Lys Trp Ser Ser Lys Ala Val Ala Pro Tyr Val
        115                 120                 125

Asp Ala Cys Ala Phe Pro Thr Pro Asp Leu Pro Ala Ile Ser Lys Ala
    130                 135                 140

Ser Gly Leu Lys Phe Phe Thr Leu Ala Phe Ile Thr Ala Asp Ser Asn
145                 150                 155                 160

Asn Lys Ala Ser Trp Ala Gly Thr Ile Pro Leu Ser Ser Gln His Leu
                165                 170                 175

Leu Ser Gln Val Arg Gln Ile Arg Ser Ser Gly Gly Asp Ile Ser Ile
            180                 185                 190

Ser Phe Gly Gly Ala Asn Gly Ile Glu Leu Ala Asp Ala Ile Lys Asp
        195                 200                 205

Val Asp Ala Leu Val Ala Glu Tyr Ser Arg Val Ile Asp Leu Tyr Ser
    210                 215                 220

Leu Thr Arg Ile Asp Phe Asp Ile Glu Gly Gly Ala Val Ala Asp Thr
225                 230                 235                 240

Glu Gly Val Asp Arg Arg Asn Lys Ala Ile Asn Ile Leu Asn Lys Lys
                245                 250                 255

Tyr Pro Asn Leu Gln Ile Thr Tyr Cys Leu Pro Val Leu Pro Thr Gly
            260                 265                 270

Leu Ala Leu Ala Gly Glu Leu Leu Val Arg Asn Ala Arg Val Asn Asn
        275                 280                 285

Ala Ile Ile His Ser Phe Asn Gly Met Ser Met Asp Phe Gly Asp Ser
    290                 295                 300

Ala Ala Pro Asp Pro Glu Gly Arg Met Gly Asp Tyr Val Ile Met Ser
305                 310                 315                 320

Cys Gln Asn Leu Arg Thr Gln Val Leu Ser Ala Gly Tyr Asp Ser Pro
                325                 330                 335

Asn Ile Gly Thr Ile Pro Met Ile Gly Val Asn Asp Val Glu Ser Glu
            340                 345                 350

Val Phe Arg Ile Ser Asp Ala Lys Lys Val Tyr Asp Phe Phe Gln Ser
        355                 360                 365

Ile Pro Trp Met Thr Tyr Val Gly Phe Trp Ser Thr Asn Arg Asp Asn
    370                 375                 380

Ala Gly Gln Gly Gln Gly Ala Asn Pro Phe Asn Ser Gly Ile Lys Gln
385                 390                 395                 400

Asn Pro Tyr Asp Phe Ser Lys Thr Phe Leu Gly Lys Lys Val Leu Glu
                405                 410                 415
```

```
Leu Asp Pro Ser Pro Arg Pro Asn Pro Pro His Ile Pro Pro Pro Gly
            420                 425                 430

Gly Asp Pro Asn Pro Leu Pro Pro Val Gly Pro Val Asp Pro Ser Pro
        435                 440                 445

Lys Pro Pro Thr Pro Lys Pro Pro Thr Pro Asn Pro Pro Thr Asn Pro
    450                 455                 460

Glu Lys Pro Gln Lys Pro Val Gln Lys Pro Asn Val Asn Ala Asp Trp
465                 470                 475                 480

Cys Asn Val Ser Leu Glu Phe Val Arg Arg Cys Arg Asp Gly Glu Ala
                485                 490                 495

Pro Asp Ala Val Ile Lys Asp Leu Gln Thr Arg Tyr Ser Gly Leu Gly
            500                 505                 510

Pro Glu Asn Gln Lys Ala Leu Lys Lys Leu Leu Asp Pro Ser Lys Pro
        515                 520                 525

Val Asp Pro Lys Pro Val Asp Pro Lys Pro Val Asp Pro Lys Pro Val
    530                 535                 540

Asp Pro Lys Pro Pro Val Lys Ser Asn Arg Phe Phe Thr Pro Tyr Thr
545                 550                 555                 560

Glu Ser Trp Gln Tyr Trp Ser Gly Trp Asn Asn Ala Lys Thr Leu Glu
                565                 570                 575

Gln Ile Pro Thr Lys Asn Val Thr Leu Ala Phe Val Leu Tyr Ala Asp
            580                 585                 590

Gly Val Pro Lys Phe Asp Gly Thr Met Asp Ala Asn Ile Tyr Val Asp
        595                 600                 605

Gln Ala Lys Ile Val Gln Thr Lys Gly Gly Ile Val Arg Ile Ser Phe
    610                 615                 620

Gly Gly Ala Thr Gly Thr Glu Leu Ala Leu Gly Ile Lys Asp Val Asn
625                 630                 635                 640

Lys Leu Ala Ala Ala Tyr Glu Ser Val Ile Lys Met Tyr Asn Thr Arg
                645                 650                 655

Asn Ile Asp Met Asp Ile Glu Gly Gly Pro Ala Ser Asp Met Asp Ser
            660                 665                 670

Ile Thr Arg Arg Asn Lys Ala Leu Val Ile Leu Gln Lys Lys Tyr Pro
        675                 680                 685

Asp Leu Lys Val Asp Tyr Thr Leu Ala Val Met Gln Thr Gly Leu Ser
    690                 695                 700

Thr Gln Gly Leu Asp Ile Leu Lys Asp Ala Lys Lys Gln Gly Leu Lys
705                 710                 715                 720

Val His Ala Val Asn Ile Met Ala Met Asp Tyr Gly Thr Asn Glu Lys
                725                 730                 735

Gln Met Gly Lys Ala Ala Ile Ser Ala Ala Thr Ala Thr Lys Lys Gln
            740                 745                 750

Cys Asp Asp Leu Gly Leu Val Tyr Glu Gly Val Gly Ile Thr Pro Met
        755                 760                 765

Ile Gly Leu Asn Asp Thr Ser Pro Glu Thr Phe Thr Ile Asp Asn Ala
    770                 775                 780

Lys Glu Val Val Asp Phe Ala Lys Lys Thr Ser Trp Val Asn Phe Leu
785                 790                 795                 800

Gly Phe Trp Ala Thr Gly Arg Asp Asn Ala Lys Asp Thr Lys Val Lys
                805                 810                 815

Gln Val Met Trp Glu Phe Thr Asn Ile Phe Asn Thr Phe Ala
            820                 825                 830
```

<210> SEQ ID NO 7
<211> LENGTH: 963
<212> TYPE: DNA
<213> ORGANISM: Chlorella Virus PBCV-1
<220> FEATURE:
<221> NAME/KEY: CDS
<222> LOCATION: (1)..(963)

<400> SEQUENCE: 7

```
atg aat gga aac gac aac tgg gat aac gta gta aaa gat tac aat aat       48
Met Asn Gly Asn Asp Asn Trp Asp Asn Val Val Lys Asp Tyr Asn Asn
1               5                   10                  15

ctt aga aaa aac ggc cat gat gaa caa gaa aca att tca ata ata aga       96
Leu Arg Lys Asn Gly His Asp Glu Gln Glu Thr Ile Ser Ile Ile Arg
            20                  25                  30

cgt aag tat acc gac ata ggt cct gtt aat caa aaa agg tta gaa gac      144
Arg Lys Tyr Thr Asp Ile Gly Pro Val Asn Gln Lys Arg Leu Glu Asp
        35                  40                  45

caa tac gaa aag ata aaa cct tcc caa aaa ccc gct cca aaa ccc gct      192
Gln Tyr Glu Lys Ile Lys Pro Ser Gln Lys Pro Ala Pro Lys Pro Ala
    50                  55                  60

ccc aaa acc gcg cca aaa tcc cct ccg gca aca aaa aat aca aat gtt      240
Pro Lys Thr Ala Pro Lys Ser Pro Pro Ala Thr Lys Asn Thr Asn Val
65                  70                  75                  80

ata agc acg tta gat ttg aat ttg tta aca aag ggg ggt ggt tct tgg      288
Ile Ser Thr Leu Asp Leu Asn Leu Leu Thr Lys Gly Gly Gly Ser Trp
                85                  90                  95

aat gta gat ggt gtg aac atg aag aaa agt gcc gtg aca aca ttt gat      336
Asn Val Asp Gly Val Asn Met Lys Lys Ser Ala Val Thr Thr Phe Asp
            100                 105                 110

ggc aag cgt gtc gtc aag gct gta tat gat aaa aac tca ggg acg agt      384
Gly Lys Arg Val Val Lys Ala Val Tyr Asp Lys Asn Ser Gly Thr Ser
        115                 120                 125

gca aac ccc ggg gtt ggc ggg ttc agt ttt tcc gca gtt ccg gat ggt      432
Ala Asn Pro Gly Val Gly Gly Phe Ser Phe Ser Ala Val Pro Asp Gly
    130                 135                 140

ctt aac aaa aac gcc ata aca ttc gct tgg gaa gta ttt tat cca aaa      480
Leu Asn Lys Asn Ala Ile Thr Phe Ala Trp Glu Val Phe Tyr Pro Lys
145                 150                 155                 160

gga ttc gat ttt gca cga ggg ggc aaa cac ggg gga acg ttt ata ggt      528
Gly Phe Asp Phe Ala Arg Gly Gly Lys His Gly Gly Thr Phe Ile Gly
                165                 170                 175

cat gga gct gct tct gga tat cag cat tct aaa acg ggt gca tcg aat      576
His Gly Ala Ala Ser Gly Tyr Gln His Ser Lys Thr Gly Ala Ser Asn
            180                 185                 190

agg atc atg tgg caa caa gat gga ggt gtc ata gac tac att tac cct      624
Arg Ile Met Trp Gln Gln Asp Gly Gly Val Ile Asp Tyr Ile Tyr Pro
        195                 200                 205

ccc tct gat cta aaa caa aag atc cgt ggt ctc gac ccc gaa ggg cat      672
Pro Ser Asp Leu Lys Gln Lys Ile Arg Gly Leu Asp Pro Glu Gly His
    210                 215                 220

gga atc gga ttt ttc gag gat gac ttt aaa aaa gcg ctg aaa tat gac      720
Gly Ile Gly Phe Phe Glu Asp Asp Phe Lys Lys Ala Leu Lys Tyr Asp
225                 230                 235                 240

gta tgg aat cgt ata gaa att gga acg aag atg aat act ttc aag aac      768
Val Trp Asn Arg Ile Glu Ile Gly Thr Lys Met Asn Thr Phe Lys Asn
                245                 250                 255

ggg gtt cct cag tta gat ggc gaa tcc tat gtt atc gtc aac gga aag      816
Gly Val Pro Gln Leu Asp Gly Glu Ser Tyr Val Ile Val Asn Gly Lys
            260                 265                 270

aag gag gtc tta aaa gga ata aat tgg tct aga agt cct gat ttg gtg      864
```

```
Lys Glu Val Leu Lys Gly Ile Asn Trp Ser Arg Ser Pro Asp Leu Val
        275                 280                 285

ata aac agg ttc gat tgg aac aca ttt ttt gga ggt cca ctc cca agt      912
Ile Asn Arg Phe Asp Trp Asn Thr Phe Phe Gly Gly Pro Leu Pro Ser
    290                 295                 300

cca aag aat cag gta gca tac ttc acg aat ttc caa atg aag aaa tac      960
Pro Lys Asn Gln Val Ala Tyr Phe Thr Asn Phe Gln Met Lys Lys Tyr
305                 310                 315                 320

gaa                                                                  963
Glu


<210> SEQ ID NO 8
<211> LENGTH: 321
<212> TYPE: PRT
<213> ORGANISM: Chlorella Virus PBCV-1

<400> SEQUENCE: 8

Met Asn Gly Asn Asp Asn Trp Asp Asn Val Val Lys Asp Tyr Asn Asn
1               5                   10                  15

Leu Arg Lys Asn Gly His Asp Glu Gln Glu Thr Ile Ser Ile Ile Arg
            20                  25                  30

Arg Lys Tyr Thr Asp Ile Gly Pro Val Asn Gln Lys Arg Leu Glu Asp
        35                  40                  45

Gln Tyr Glu Lys Ile Lys Pro Ser Gln Lys Pro Ala Pro Lys Pro Ala
    50                  55                  60

Pro Lys Thr Ala Pro Lys Ser Pro Pro Ala Thr Lys Asn Thr Asn Val
65                  70                  75                  80

Ile Ser Thr Leu Asp Leu Asn Leu Leu Thr Lys Gly Gly Gly Ser Trp
                85                  90                  95

Asn Val Asp Gly Val Asn Met Lys Lys Ser Ala Val Thr Thr Phe Asp
            100                 105                 110

Gly Lys Arg Val Val Lys Ala Val Tyr Asp Lys Asn Ser Gly Thr Ser
        115                 120                 125

Ala Asn Pro Gly Val Gly Gly Phe Ser Phe Ser Ala Val Pro Asp Gly
    130                 135                 140

Leu Asn Lys Asn Ala Ile Thr Phe Ala Trp Glu Val Phe Tyr Pro Lys
145                 150                 155                 160

Gly Phe Asp Phe Ala Arg Gly Gly Lys His Gly Gly Thr Phe Ile Gly
                165                 170                 175

His Gly Ala Ala Ser Gly Tyr Gln His Ser Lys Thr Gly Ala Ser Asn
            180                 185                 190

Arg Ile Met Trp Gln Gln Asp Gly Gly Val Ile Asp Tyr Ile Tyr Pro
        195                 200                 205

Pro Ser Asp Leu Lys Gln Lys Ile Arg Gly Leu Asp Pro Glu Gly His
    210                 215                 220

Gly Ile Gly Phe Phe Glu Asp Asp Phe Lys Lys Ala Leu Lys Tyr Asp
225                 230                 235                 240

Val Trp Asn Arg Ile Glu Ile Gly Thr Lys Met Asn Thr Phe Lys Asn
                245                 250                 255

Gly Val Pro Gln Leu Asp Gly Glu Ser Tyr Val Ile Val Asn Gly Lys
            260                 265                 270

Lys Glu Val Leu Lys Gly Ile Asn Trp Ser Arg Ser Pro Asp Leu Val
        275                 280                 285

Ile Asn Arg Phe Asp Trp Asn Thr Phe Phe Gly Gly Pro Leu Pro Ser
    290                 295                 300
```

```
Pro Lys Asn Gln Val Ala Tyr Phe Thr Asn Phe Gln Met Lys Lys Tyr
305                 310                 315                 320

Glu


<210> SEQ ID NO 9
<211> LENGTH: 1515
<212> TYPE: DNA
<213> ORGANISM: Chlorella Virus PBCV-1
<220> FEATURE:
<221> NAME/KEY: CDS
<222> LOCATION: (1)..(1515)

<400> SEQUENCE: 9

atg gcc ctt gcg aaa cct gct ccg tat tat acg agc ccc act gga aaa       48
Met Ala Leu Ala Lys Pro Ala Pro Tyr Tyr Thr Ser Pro Thr Gly Lys
1               5                   10                  15

cag gca ata tat tac cat act tca tgg agc tgc tac gac aga aag ttc       96
Gln Ala Ile Tyr Tyr His Thr Ser Trp Ser Cys Tyr Asp Arg Lys Phe
            20                  25                  30

tac ccc gtc aaa cta cca att gac aaa ctt aca gac atc gca tac gca      144
Tyr Pro Val Lys Leu Pro Ile Asp Lys Leu Thr Asp Ile Ala Tyr Ala
        35                  40                  45

ttc ttc aac gtt gat gag acc ggt agg gta ttc tcc gga gac gag tgg      192
Phe Phe Asn Val Asp Glu Thr Gly Arg Val Phe Ser Gly Asp Glu Trp
    50                  55                  60

agc gac tac caa atg ccg ttc aat ggt cct ggc gaa ggc gtt gaa cct      240
Ser Asp Tyr Gln Met Pro Phe Asn Gly Pro Gly Glu Gly Val Glu Pro
65                  70                  75                  80

caa aat aaa tgg gat tca cca ccc gaa caa tta gga caa cta ggt cag      288
Gln Asn Lys Trp Asp Ser Pro Pro Glu Gln Leu Gly Gln Leu Gly Gln
                85                  90                  95

ttc ttg aaa ctg ctt aaa aag gaa cac aag ttc aac atg cac gcg tct      336
Phe Leu Lys Leu Leu Lys Lys Glu His Lys Phe Asn Met His Ala Ser
            100                 105                 110

ata ggc ggg tgg agt tgg agt ggt aat ttt tcc aat gcg gtt aaa aca      384
Ile Gly Gly Trp Ser Trp Ser Gly Asn Phe Ser Asn Ala Val Lys Thr
        115                 120                 125

gag gaa aat cgc gag agg ttc gtt acc agt ctg gcg gga atc atg aac      432
Glu Glu Asn Arg Glu Arg Phe Val Thr Ser Leu Ala Gly Ile Met Asn
    130                 135                 140

aga tac cca ggt cta ttt aat tct att tcg ctt gac tgg gaa tat gtg      480
Arg Tyr Pro Gly Leu Phe Asn Ser Ile Ser Leu Asp Trp Glu Tyr Val
145                 150                 155                 160

tcg gac gat ggt gtc aac tat ggt cta ggc gga aac gcc gtt agc aaa      528
Ser Asp Asp Gly Val Asn Tyr Gly Leu Gly Gly Asn Ala Val Ser Lys
                165                 170                 175

gaa gac ccc gat aat ttt atg aaa ctc cta aag aaa atc cgt caa aag      576
Glu Asp Pro Asp Asn Phe Met Lys Leu Leu Lys Lys Ile Arg Gln Lys
            180                 185                 190

ctc cca ggt ttt aag ata tca atg tgc aca att gcc gct cca gaa aaa      624
Leu Pro Gly Phe Lys Ile Ser Met Cys Thr Ile Ala Ala Pro Glu Lys
        195                 200                 205

ctt aaa ttc ccc gtg aaa aaa gta agt gaa ctt ctg gac gag gtt cac      672
Leu Lys Phe Pro Val Lys Lys Val Ser Glu Leu Leu Asp Glu Val His
    210                 215                 220

gtg atg aca tac gat ttc ctt gac ggg tcg tgg gcg caa gga ggt ggt      720
Val Met Thr Tyr Asp Phe Leu Asp Gly Ser Trp Ala Gln Gly Gly Gly
225                 230                 235                 240

cca gcc act gga cat cac acg aac ttt agt aaa tca cca ctc gtt ccc      768
Pro Ala Thr Gly His His Thr Asn Phe Ser Lys Ser Pro Leu Val Pro
                245                 250                 255
```

```
tac tcg gta acc gac gcc gcc gaa acg atg ctc aaa ctc ggt gtt gac      816
Tyr Ser Val Thr Asp Ala Ala Glu Thr Met Leu Lys Leu Gly Val Asp
            260                 265                 270

cct aaa aaa ata ttc gtc ggt gtt gcg ttt tat tct aga ggg ttc agt      864
Pro Lys Lys Ile Phe Val Gly Val Ala Phe Tyr Ser Arg Gly Phe Ser
        275                 280                 285

ggc acc gat ggt cta gga aaa cca tat aca ggc ggt tct aca gac aaa      912
Gly Thr Asp Gly Leu Gly Lys Pro Tyr Thr Gly Gly Ser Thr Asp Lys
    290                 295                 300

aca tgg gac aat ggt tcg gta gat tat aaa ttt tta ccc cta cct ggg      960
Thr Trp Asp Asn Gly Ser Val Asp Tyr Lys Phe Leu Pro Leu Pro Gly
305                 310                 315                 320

gca caa gaa cta tgg gac ccc gtt gca aac gct gcc tat tca tac gat     1008
Ala Gln Glu Leu Trp Asp Pro Val Ala Asn Ala Ala Tyr Ser Tyr Asp
                325                 330                 335

ccg aaa aaa agg gtg ttg aat tca tac gac gaa cct cgc tct gta aaa     1056
Pro Lys Lys Arg Val Leu Asn Ser Tyr Asp Glu Pro Arg Ser Val Lys
            340                 345                 350

cta aaa tgc gac ttt gtt cac caa aaa ggt ctc ggt ggt atc ttg gta     1104
Leu Lys Cys Asp Phe Val His Gln Lys Gly Leu Gly Gly Ile Leu Val
        355                 360                 365

tgg gag gat tcc gca gat cac ccg tac gat cac cca cgt tcg ctc atg     1152
Trp Glu Asp Ser Ala Asp His Pro Tyr Asp His Pro Arg Ser Leu Met
    370                 375                 380

aaa att att cac gat aat ctg acc cac ggg gaa aat gcc aaa ccc gaa     1200
Lys Ile Ile His Asp Asn Leu Thr His Gly Glu Asn Ala Lys Pro Glu
385                 390                 395                 400

ccg acc ccc aaa ccc gaa ccg acc ccc aaa ccc gaa ccg acc ccg aaa     1248
Pro Thr Pro Lys Pro Glu Pro Thr Pro Lys Pro Glu Pro Thr Pro Lys
                405                 410                 415

cct gaa cct act cca aaa cct aaa ccg acc ccc aaa ccc gaa ccg acc     1296
Pro Glu Pro Thr Pro Lys Pro Lys Pro Thr Pro Lys Pro Glu Pro Thr
            420                 425                 430

ccc aaa cct aaa ccg acc ccc aaa cct aaa ccg acc ccc aaa cct aaa     1344
Pro Lys Pro Lys Pro Thr Pro Lys Pro Lys Pro Thr Pro Lys Pro Lys
        435                 440                 445

ccg acc cca aaa cct aaa ccg acc ccg acc ccg aag cct gac ccg att     1392
Pro Thr Pro Lys Pro Lys Pro Thr Pro Thr Pro Lys Pro Asp Pro Ile
    450                 455                 460

cct aaa gaa ggt att tgg ggt gtt gac gga gaa tca ttc ttt tat aat     1440
Pro Lys Glu Gly Ile Trp Gly Val Asp Gly Glu Ser Phe Phe Tyr Asn
465                 470                 475                 480

ggt ggt att aaa atg aat tgt cca cca ggg ctc gta tgg aac tcg acg     1488
Gly Gly Ile Lys Met Asn Cys Pro Pro Gly Leu Val Trp Asn Ser Thr
                485                 490                 495

agt aaa tct tgt gat tgg cct aag aaa                                 1515
Ser Lys Ser Cys Asp Trp Pro Lys Lys
            500                 505


<210> SEQ ID NO 10
<211> LENGTH: 505
<212> TYPE: PRT
<213> ORGANISM: Chlorella Virus PBCV-1

<400> SEQUENCE: 10

Met Ala Leu Ala Lys Pro Ala Pro Tyr Tyr Thr Ser Pro Thr Gly Lys
1               5                   10                  15

Gln Ala Ile Tyr Tyr His Thr Ser Trp Ser Cys Tyr Asp Arg Lys Phe
            20                  25                  30
```

```
Tyr Pro Val Lys Leu Pro Ile Asp Lys Leu Thr Asp Ile Ala Tyr Ala
        35                  40                  45

Phe Phe Asn Val Asp Glu Thr Gly Arg Val Phe Ser Gly Asp Glu Trp
    50                  55                  60

Ser Asp Tyr Gln Met Pro Phe Asn Gly Pro Gly Glu Gly Val Glu Pro
65                  70                  75                  80

Gln Asn Lys Trp Asp Ser Pro Pro Glu Gln Leu Gly Gln Leu Gly Gln
                85                  90                  95

Phe Leu Lys Leu Leu Lys Lys Glu His Lys Phe Asn Met His Ala Ser
            100                 105                 110

Ile Gly Gly Trp Ser Trp Ser Gly Asn Phe Ser Asn Ala Val Lys Thr
        115                 120                 125

Glu Glu Asn Arg Glu Arg Phe Val Thr Ser Leu Ala Gly Ile Met Asn
    130                 135                 140

Arg Tyr Pro Gly Leu Phe Asn Ser Ile Ser Leu Asp Trp Glu Tyr Val
145                 150                 155                 160

Ser Asp Asp Gly Val Asn Tyr Gly Leu Gly Gly Asn Ala Val Ser Lys
                165                 170                 175

Glu Asp Pro Asp Asn Phe Met Lys Leu Leu Lys Lys Ile Arg Gln Lys
            180                 185                 190

Leu Pro Gly Phe Lys Ile Ser Met Cys Thr Ile Ala Ala Pro Glu Lys
        195                 200                 205

Leu Lys Phe Pro Val Lys Lys Val Ser Glu Leu Leu Asp Glu Val His
    210                 215                 220

Val Met Thr Tyr Asp Phe Leu Asp Gly Ser Trp Ala Gln Gly Gly Gly
225                 230                 235                 240

Pro Ala Thr Gly His His Thr Asn Phe Ser Lys Ser Pro Leu Val Pro
                245                 250                 255

Tyr Ser Val Thr Asp Ala Ala Glu Thr Met Leu Lys Leu Gly Val Asp
            260                 265                 270

Pro Lys Lys Ile Phe Val Gly Val Ala Phe Tyr Ser Arg Gly Phe Ser
        275                 280                 285

Gly Thr Asp Gly Leu Gly Lys Pro Tyr Thr Gly Gly Ser Thr Asp Lys
    290                 295                 300

Thr Trp Asp Asn Gly Ser Val Asp Tyr Lys Phe Leu Pro Leu Pro Gly
305                 310                 315                 320

Ala Gln Glu Leu Trp Asp Pro Val Ala Asn Ala Ala Tyr Ser Tyr Asp
                325                 330                 335

Pro Lys Lys Arg Val Leu Asn Ser Tyr Asp Glu Pro Arg Ser Val Lys
            340                 345                 350

Leu Lys Cys Asp Phe Val His Gln Lys Gly Leu Gly Gly Ile Leu Val
        355                 360                 365

Trp Glu Asp Ser Ala Asp His Pro Tyr Asp His Pro Arg Ser Leu Met
    370                 375                 380

Lys Ile Ile His Asp Asn Leu Thr His Gly Glu Asn Ala Lys Pro Glu
385                 390                 395                 400

Pro Thr Pro Lys Pro Glu Pro Thr Pro Lys Pro Glu Pro Thr Pro Lys
                405                 410                 415

Pro Glu Pro Thr Pro Lys Pro Lys Pro Thr Pro Lys Pro Glu Pro Thr
            420                 425                 430

Pro Lys Pro Lys Pro Thr Pro Lys Pro Lys Pro Thr Pro Lys Pro Lys
        435                 440                 445

Pro Thr Pro Lys Pro Lys Pro Thr Pro Thr Pro Lys Pro Asp Pro Ile
```

```
    450                 455                 460

Pro Lys Glu Gly Ile Trp Gly Val Asp Gly Glu Ser Phe Phe Tyr Asn
465                 470                 475                 480

Gly Gly Ile Lys Met Asn Cys Pro Pro Gly Leu Val Trp Asn Ser Thr
                485                 490                 495

Ser Lys Ser Cys Asp Trp Pro Lys Lys
            500                 505


<210> SEQ ID NO 11
<211> LENGTH: 984
<212> TYPE: DNA
<213> ORGANISM: Chlorella Virus PBCV-1
<220> FEATURE:
<221> NAME/KEY: CDS
<222> LOCATION: (1)..(984)

<400> SEQUENCE: 11

atg tca aac aaa ata gaa ata aca gac gat aat aaa atg acg att caa       48
Met Ser Asn Lys Ile Glu Ile Thr Asp Asp Asn Lys Met Thr Ile Gln
1               5                   10                  15

aac gac ttt gta tca cgg atg atg aag agt atc gat cag gaa ctc gtt       96
Asn Asp Phe Val Ser Arg Met Met Lys Ser Ile Asp Gln Glu Leu Val
            20                  25                  30

gcc atg acg aac aaa tat tct ggg ttc ggt cct ggc aga cag acg aat      144
Ala Met Thr Asn Lys Tyr Ser Gly Phe Gly Pro Gly Arg Gln Thr Asn
        35                  40                  45

tgc aaa aaa gct ctt gca aag gcc ctc gga gaa acc cca gtc aac ccc      192
Cys Lys Lys Ala Leu Ala Lys Ala Leu Gly Glu Thr Pro Val Asn Pro
    50                  55                  60

cca gtc aac ccc cca gta acc cct cct gta gat aca cat att cct tca      240
Pro Val Asn Pro Pro Val Thr Pro Pro Val Asp Thr His Ile Pro Ser
65                  70                  75                  80

cag gtc gaa gct cct ttg aaa aaa cta ggc ttc aat aca aca aat gca      288
Gln Val Glu Ala Pro Leu Lys Lys Leu Gly Phe Asn Thr Thr Asn Ala
                85                  90                  95

gac acg atc tta tca ctc atc gcg ctc ccg gaa aac tct aca acc caa      336
Asp Thr Ile Leu Ser Leu Ile Ala Leu Pro Glu Asn Ser Thr Thr Gln
            100                 105                 110

tgg tgg aaa aat tac aat tac gca agt tgt cta aag gac ggt cgt gga      384
Trp Trp Lys Asn Tyr Asn Tyr Ala Ser Cys Leu Lys Asp Gly Arg Gly
        115                 120                 125

tgg aca gta aca att tac ggt gca tgc tct ggg act ggt gat ctg ttg      432
Trp Thr Val Thr Ile Tyr Gly Ala Cys Ser Gly Thr Gly Asp Leu Leu
    130                 135                 140

atg gta ttg gag tct ctg caa aaa ata aac cct aac cac cca ctc gtg      480
Met Val Leu Glu Ser Leu Gln Lys Ile Asn Pro Asn His Pro Leu Val
145                 150                 155                 160

aaa ttc atc ccc gca atg agg aaa acc aag gga gat gat atc aga ggc      528
Lys Phe Ile Pro Ala Met Arg Lys Thr Lys Gly Asp Asp Ile Arg Gly
                165                 170                 175

ctc gaa aat ctc ggg aaa gta atc aac ggg ctc ggc gac gac aaa gaa      576
Leu Glu Asn Leu Gly Lys Val Ile Asn Gly Leu Gly Asp Asp Lys Glu
            180                 185                 190

tgg caa acg gcg gtg tgg gac ata tac gtc aaa tta tat tgg act ttt      624
Trp Gln Thr Ala Val Trp Asp Ile Tyr Val Lys Leu Tyr Trp Thr Phe
        195                 200                 205

gct gcc gat ttt tca gac aag act gga agt gcg aaa aac cgc ccc ggg      672
Ala Ala Asp Phe Ser Asp Lys Thr Gly Ser Ala Lys Asn Arg Pro Gly
    210                 215                 220

ccc gtt atg acg tca cca ttg aca cgt ggt ttt atg gta gat gtt gcg      720
```

```
Pro Val Met Thr Ser Pro Leu Thr Arg Gly Phe Met Val Asp Val Ala
225                 230                 235                 240

ttg aac cac ggg agt aat atg gaa tcc ttt tcc gac att cta aag aga      768
Leu Asn His Gly Ser Asn Met Glu Ser Phe Ser Asp Ile Leu Lys Arg
                245                 250                 255

atg aaa aat cgc gaa gag aaa gac gag gcg aaa tgg ttc ctc gat ttc      816
Met Lys Asn Arg Glu Glu Lys Asp Glu Ala Lys Trp Phe Leu Asp Phe
            260                 265                 270

tgc gag aca aga cgt aaa ctt cta aaa gct ggt ttc caa gat ctt gat      864
Cys Glu Thr Arg Arg Lys Leu Leu Lys Ala Gly Phe Gln Asp Leu Asp
        275                 280                 285

act tct aaa aca gga gat cgc tgt aca ctt tgg gca aac atc ttc aaa      912
Thr Ser Lys Thr Gly Asp Arg Cys Thr Leu Trp Ala Asn Ile Phe Lys
    290                 295                 300

gaa gga aac gtt ggg ctg aaa cgc ccg ata aaa tgc tac aat ggt tac      960
Glu Gly Asn Val Gly Leu Lys Arg Pro Ile Lys Cys Tyr Asn Gly Tyr
305                 310                 315                 320

tgg ggt aaa aac ata gtt att tca                                      984
Trp Gly Lys Asn Ile Val Ile Ser
                325


<210> SEQ ID NO 12
<211> LENGTH: 328
<212> TYPE: PRT
<213> ORGANISM: Chlorella Virus PBCV-1

<400> SEQUENCE: 12

Met Ser Asn Lys Ile Glu Ile Thr Asp Asp Asn Lys Met Thr Ile Gln
1               5                   10                  15

Asn Asp Phe Val Ser Arg Met Met Lys Ser Ile Asp Gln Glu Leu Val
            20                  25                  30

Ala Met Thr Asn Lys Tyr Ser Gly Phe Gly Pro Gly Arg Gln Thr Asn
        35                  40                  45

Cys Lys Lys Ala Leu Ala Lys Ala Leu Gly Glu Thr Pro Val Asn Pro
    50                  55                  60

Pro Val Asn Pro Pro Val Thr Pro Pro Val Asp Thr His Ile Pro Ser
65                  70                  75                  80

Gln Val Glu Ala Pro Leu Lys Lys Leu Gly Phe Asn Thr Thr Asn Ala
                85                  90                  95

Asp Thr Ile Leu Ser Leu Ile Ala Leu Pro Glu Asn Ser Thr Thr Gln
            100                 105                 110

Trp Trp Lys Asn Tyr Asn Tyr Ala Ser Cys Leu Lys Asp Gly Arg Gly
        115                 120                 125

Trp Thr Val Thr Ile Tyr Gly Ala Cys Ser Gly Thr Gly Asp Leu Leu
    130                 135                 140

Met Val Leu Glu Ser Leu Gln Lys Ile Asn Pro Asn His Pro Leu Val
145                 150                 155                 160

Lys Phe Ile Pro Ala Met Arg Lys Thr Lys Gly Asp Asp Ile Arg Gly
                165                 170                 175

Leu Glu Asn Leu Gly Lys Val Ile Asn Gly Leu Gly Asp Asp Lys Glu
            180                 185                 190

Trp Gln Thr Ala Val Trp Asp Ile Tyr Val Lys Leu Tyr Trp Thr Phe
        195                 200                 205

Ala Ala Asp Phe Ser Asp Lys Thr Gly Ser Ala Lys Asn Arg Pro Gly
    210                 215                 220

Pro Val Met Thr Ser Pro Leu Thr Arg Gly Phe Met Val Asp Val Ala
225                 230                 235                 240
```

-continued

```
Leu Asn His Gly Ser Asn Met Glu Ser Phe Ser Asp Ile Leu Lys Arg
                245                 250                 255

Met Lys Asn Arg Glu Glu Lys Asp Glu Ala Lys Trp Phe Leu Asp Phe
            260                 265                 270

Cys Glu Thr Arg Arg Lys Leu Leu Lys Ala Gly Phe Gln Asp Leu Asp
        275                 280                 285

Thr Ser Lys Thr Gly Asp Arg Cys Thr Leu Trp Ala Asn Ile Phe Lys
    290                 295                 300

Glu Gly Asn Val Gly Leu Lys Arg Pro Ile Lys Cys Tyr Asn Gly Tyr
305                 310                 315                 320

Trp Gly Lys Asn Ile Val Ile Ser
                325
```

We claim:

1. A method for recovering lipids from a microbial cell containing a cell wall, comprising:

a) contacting the microbial cell with at least one cell wall degrading enzyme, wherein the at least one cell wall degrading enzyme is A94L, A122R, or A215L from the *Chlorella* virus PBCV-1; and b) isolating lipids from the microbial cell.

2. The method of claim 1, wherein the microbial cell is an algal or a yeast cell.

3. The method of claim 2, wherein the algal cell is from the genus *Chlorella, Nannochloropsis*, or *Selenastrum*.

4. The method of claim 3, wherein the algal cell is a strain of the species *Chlorella vulgaris*.

5. The method of claim 1, further comprising a step of dewatering the cell prior to the step of contacting the cell with at least one cell wall degrading enzyme.

6. The method of claim 5, wherein the cell is dewatered to about 10-40% solids prior to the step of contacting the cell with at least one cell wall degrading enzyme.

7. The method of claim 1, wherein the step of isolating lipids from the cell comprises extracting the lipids by mixing the contacted cells with a hexane/isopropanol solvent and recovering the lipids from the solvent.

8. The method of claim 7, wherein extracting the lipids is carried out at a temperature of about 18° C. to 30° C.

9. The method of claim 7, wherein extracting the lipids is carried out for about 1 to 4 hours.

10. The method of claim 7, wherein the solvent is 3:2 hexane:isopropanol by volume.

11. A method for recovering lipids from an algal cell, comprising:

a) culturing an algal cell containing at least one exogenous gene selected from A94L, A122R, or A215L from the *Chlorella* virus PBCV-1;

b) inducing expression of the at least one exogenous gene in the algal cell and culturing the cell to allow for cell wall degradation and lipid release; and c) extracting lipids from the algal cell by mixing the algal cell with a hexane/isopropanol solvent, separating out the solids, and recovering the lipids from the solvent.

12. The method of claim 11, wherein the algal cell is from the genus *Chlorella, Nannochloropsis*, or *Selenastrum*.

13. The method of claim 12, wherein the algal cell is a strain of the species *Chlorella vulgaris*.

14. The method of claim 11, further comprising contacting the algal cell with an externally added cell wall degrading enzyme prior to extracting lipids from the algal cell.

15. The method of claim 14, further comprising a step of dewatering the cell prior to the step of contacting the cell with at least one cell wall degrading enzyme.

16. The method of claim 11, wherein extracting the lipids is carried out at a temperature of about 18° C. to 30° C.

17. The method of claim 11, wherein extracting the lipids is carried out for about 1 to 4 hours.

18. The method of claim 11, wherein the solvent is 3:2 hexane:isopropanol by volume.

19. The method of claim 1, wherein the at least one cell wall degrading enzyme further comprises at least one additional cell wall degrading enzyme-selected from A181/182R, A260R, or A292L from the *Chlorella* virus PBCV-1.

20. The method of claim 4, wherein the at least one cell wall degrading enzyme further comprises at least one additional cell wall degrading enzyme-selected from A181/182R, A260R, or A292L from the *Chlorella* virus PBCV-1.

* * * * *